US010777116B1

(12) United States Patent
Vahid Far et al.

(10) Patent No.: US 10,777,116 B1
(45) Date of Patent: Sep. 15, 2020

(54) ELECTRONIC DISPLAY EMISSION SCANNING

(71) Applicant: Apple Inc., Cupertino, CA (US)

(72) Inventors: Mohammad B. Vahid Far, San Jose, CA (US); Tore Nauta, Santa Cruz, CA (US); Hopil Bae, Sunnyvale, CA (US); Yafei Bi, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 129 days.

(21) Appl. No.: 15/251,906

(22) Filed: Aug. 30, 2016

Related U.S. Application Data

(60) Provisional application No. 62/232,935, filed on Sep. 25, 2015.

(51) Int. Cl.
*G09G 3/20* (2006.01)

(52) U.S. Cl.
CPC ... *G09G 3/2018* (2013.01); *G09G 2320/0266* (2013.01); *G09G 2320/064* (2013.01); *G09G 2320/0666* (2013.01)

(58) Field of Classification Search
CPC ..... G09G 3/2018; G09G 2320/0666
See application file for complete search history.

(56) References Cited

U.S. PATENT DOCUMENTS 6,426,743 B1 * 7/2002 Yeo ..... G09G 3/3677 345/100
8,392,775 B2 * 3/2013 Liu ..... G01R 31/318552 714/729
8,854,353 B2 * 10/2014 Chung ..... G09G 3/3266 345/204
8,988,406 B2 * 3/2015 Chung ..... G09G 3/3266 345/208
9,454,934 B2 * 9/2016 Woo ..... G09G 3/3266
9,454,935 B2 * 9/2016 Park ..... G09G 3/3233
9,472,303 B2 * 10/2016 Ma ..... G11C 19/28
2006/0145964 A1 * 7/2006 Park ..... G09G 3/3233 345/76
2006/0156121 A1 * 7/2006 Chung ..... G09G 3/3233 714/726
2007/0063933 A1 * 3/2007 Chung ..... G09G 3/3266 345/76
2010/0188316 A1 * 7/2010 Jang ..... G09G 3/3266 345/76
2010/0207848 A1 * 8/2010 Cok ..... G09G 3/2085 345/76
2011/0041020 A1 * 2/2011 Liu ..... G01R 31/318536 714/731
2011/0069094 A1 * 3/2011 Knapp ..... G09G 3/2003 345/690
2011/0310074 A1 * 12/2011 Ochiai ..... G09G 3/3674 345/208
2012/0169574 A1 * 7/2012 Kim ..... G09G 3/3233 345/76

(Continued)

*Primary Examiner* — Nitin Patel
*Assistant Examiner* — Robert M Stone
(74) *Attorney, Agent, or Firm* — Fletcher Yoder P.C.

(57) ABSTRACT

An electronic display includes a timing controller configured to distribute emission periods throughout an active area of the display over time by generating a plurality of emission clock phases. The electronic display also includes multiple row drivers configured to cause rows of pixels to emit at multiple different emission periods.

20 Claims, 22 Drawing Sheets

(56) References Cited

U.S. PATENT DOCUMENTS

| | | | | |
|---|---|---|---|---|
| 2012/0206499 | A1* | 8/2012 | Cok | G09G 3/3208 345/690 |
| 2015/0035733 | A1* | 2/2015 | Woo | G09G 3/3266 345/76 |
| 2015/0061982 | A1* | 3/2015 | Woo | G09G 3/3266 345/82 |
| 2015/0138180 | A1* | 5/2015 | Park | G09G 3/3233 345/212 |
| 2015/0170568 | A1* | 6/2015 | Lee | G11C 19/287 345/690 |
| 2015/0294619 | A1* | 10/2015 | Lee | G09G 3/3266 345/77 |
| 2015/0339982 | A1* | 11/2015 | Zhang | G09G 3/3291 345/690 |
| 2016/0035262 | A1* | 2/2016 | Lee | G09G 3/3266 345/690 |
| 2016/0210895 | A1* | 7/2016 | Fan | G09G 3/3208 |
| 2016/0379558 | A1* | 12/2016 | Jeon | G09G 3/3225 345/213 |
| 2017/0263188 | A1* | 9/2017 | Na | G09G 3/3266 |
| 2018/0091151 | A1* | 3/2018 | Zheng | H03K 19/096 |

* cited by examiner

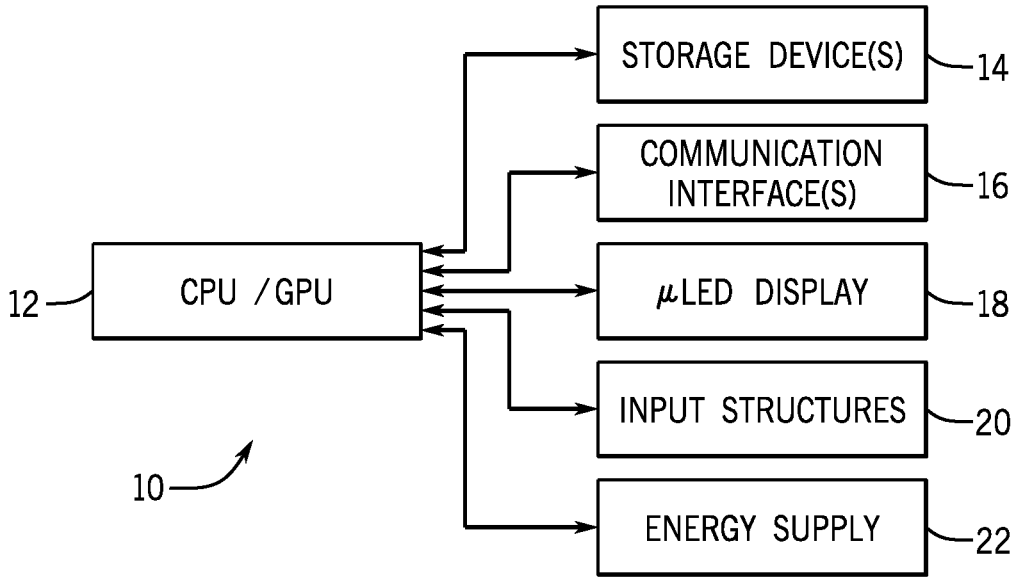
FIG. 1
FIG. 2
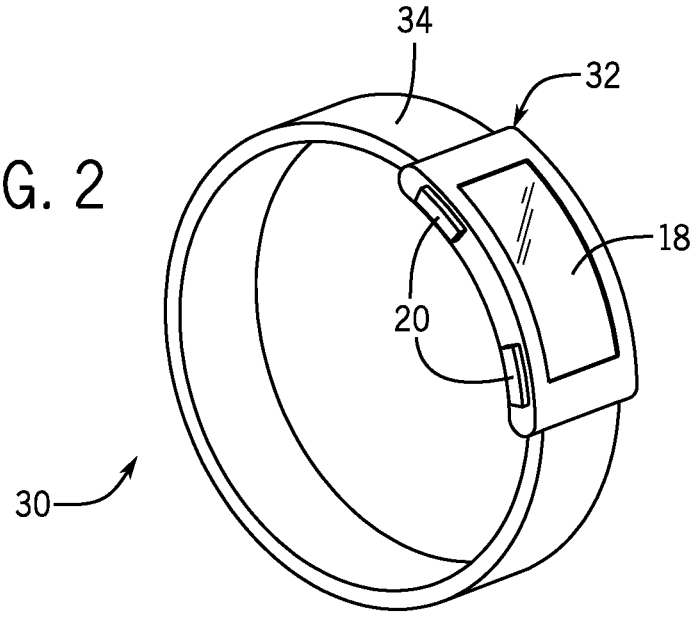

ELECTRONIC DISPLAY EMISSION SCANNING

CROSS-REFERENCE TO RELATED APPLICATIONS

This application claims the benefit of Provisional Application Ser. No. 62/232,935, filed Sep. 25, 2015, entitled "Electronic Display Emission Scanning," which is incorporated by reference herein in its entirety.

BACKGROUND

The present disclosure relates generally to techniques for driving a display and, more particularly, to techniques for emission scanning of the electronic display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Emission control for electronic displays may include pulse width modulation to cause various gray levels and luminance values. However, with a relatively high duty cycle (e.g., 75%) emission voltage (IR) drop can effect more strongly. IR drop in the panel can impact the overdrive voltage of the current source inside and cause brightness errors and display artifacts. Severity of the artifacts is display pattern dependent, and the problem is worsened as we only the further the more pixels that serially share a supply. In other words, more pixels sharing a supply may increase the IR drop to cause non-uniformity of the display and/or artifacts which degrade display quality.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Row drivers and column drivers may be used to distribute clock and/or emission controls for the display. In other words, the row and column drivers, in combination, enable the display to accurately pinpoint individual pixels and/or sub-pixels or groups of pixels and/or sub-pixels that are to be driven. These row drivers may have redundant counterparts that increase possible complications/spacing in locating components within a display. To alleviate some complexity of trace and/or spacing. Row driver sets (a primary and slave row driver) may be located at opposing ends of an active area of the display. The task allocations between the sets may include dividing the roles of each row driver by color. For example, a first row driver set may drive red sub-pixels while a second row driver set drives blue and/or green sub-pixels.

BRIEF DESCRIPTION OF THE DRAWINGS

Various aspects of this disclosure may be better understood upon reading the following detailed description and upon reference to the drawings in which:

FIG. 1 is a block diagram of components of an electronic device that may include a micro-light-emitting-diode (μ-LED) display, in accordance with an embodiment;

FIG. 2 is a perspective view of the electronic device in the form of a fitness band, in accordance with an embodiment;

DETAILED DESCRIPTION OF SPECIFIC EMBODIMENTS

Figure 3:
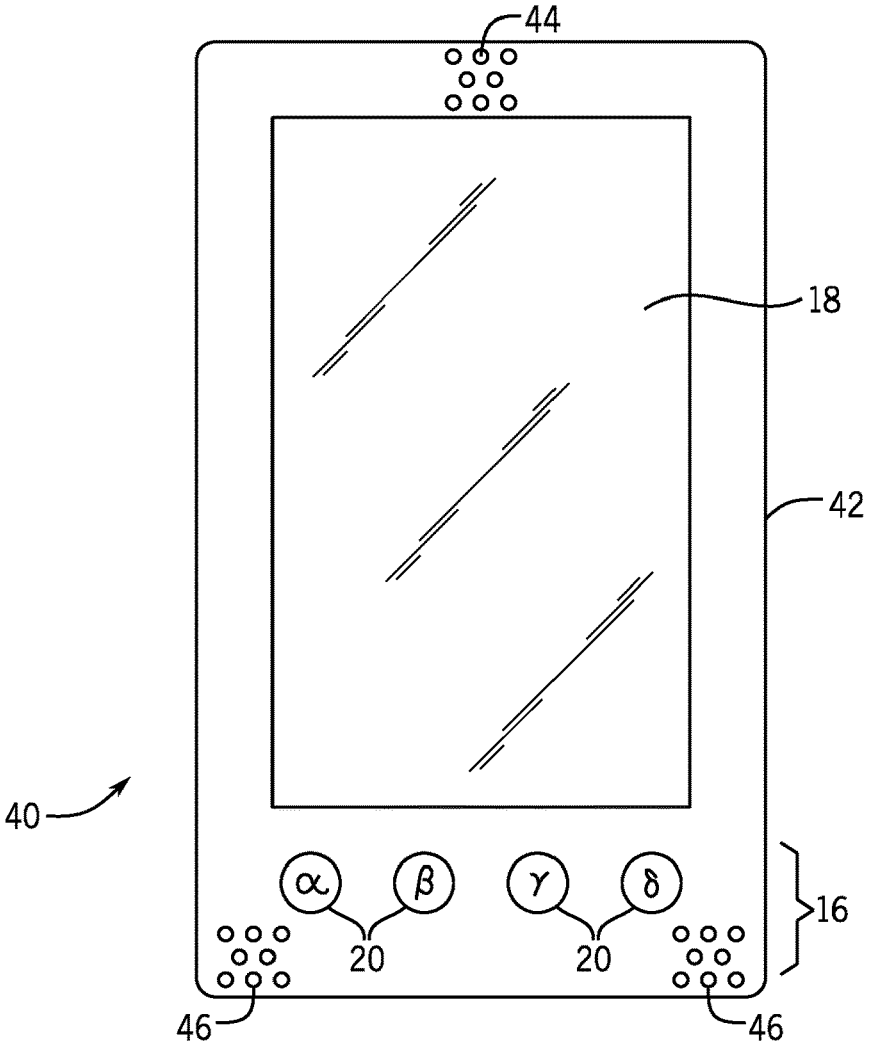
FIG. 3 is a front view of the electronic device in the form of a slate, in accordance with an embodiment.
Figure 4:
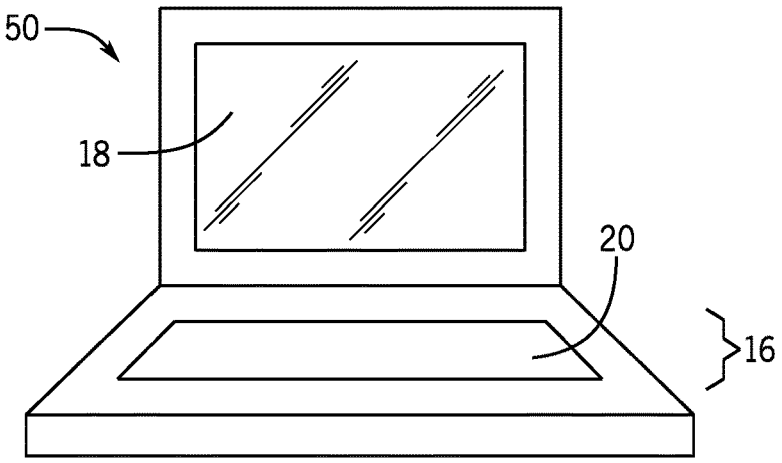
FIG. 4 is a perspective view of the electronic device in the form of a notebook computer, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, IR drop may cause display artifacts. The IR drop may refer to an analog IR drop or a digital IR drop. Analog IR drop is at a low frequency due to the current through the passing through the micro light emitting diodes. Digital IR drop refers to an IR drop caused by digital switching (e.g., emission scanning). One or more of the IR drops may be distributed throughout the display geographically and/or temporally. For example, multiple emission phases may be used to control when and where the display is emitting light. Moreover, using some limitations on duty cycle (e.g., less than 50% and/or less than 12%), a single microdriver capable of driving a single pixel may be used to drive additional pixels with some minor changes (e.g., doubling the buffer).

Suitable electronic devices that may include a micro-LED (μ-LED) display and corresponding circuitry of this disclosure are discussed below with reference to FIGS. 1-4. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a long-term evolution (LTE) cellular network.

Using pixels containing an arrangement μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

As may be appreciated, the electronic device 10 may take a number of different forms. As shown in FIG. 2, the electronic device 10 may take the form of a fitness band 30. The fitness band 30 may include an enclosure 32 that houses the electronic device 10 components of the fitness band 30. A strap 30 may allow the fitness band 30 to be worn on the arm or wrist. The display 18 may display information related to the fitness band operation. Additionally or alternatively, the fitness band 30 may operate as a watch, in which case the display 18 may display the time. Input structures 20 may allow a person wearing the fitness band 30 navigate a graphical user interface (GUI) on the display 18.

The electronic device 10 may also take the form of a slate 40. Depending on the size of the slate 40, the slate 40 may serve as a handheld device such as a mobile phone. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired connection to another electronic device.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal service bus (USB) connection.

Figure 5:
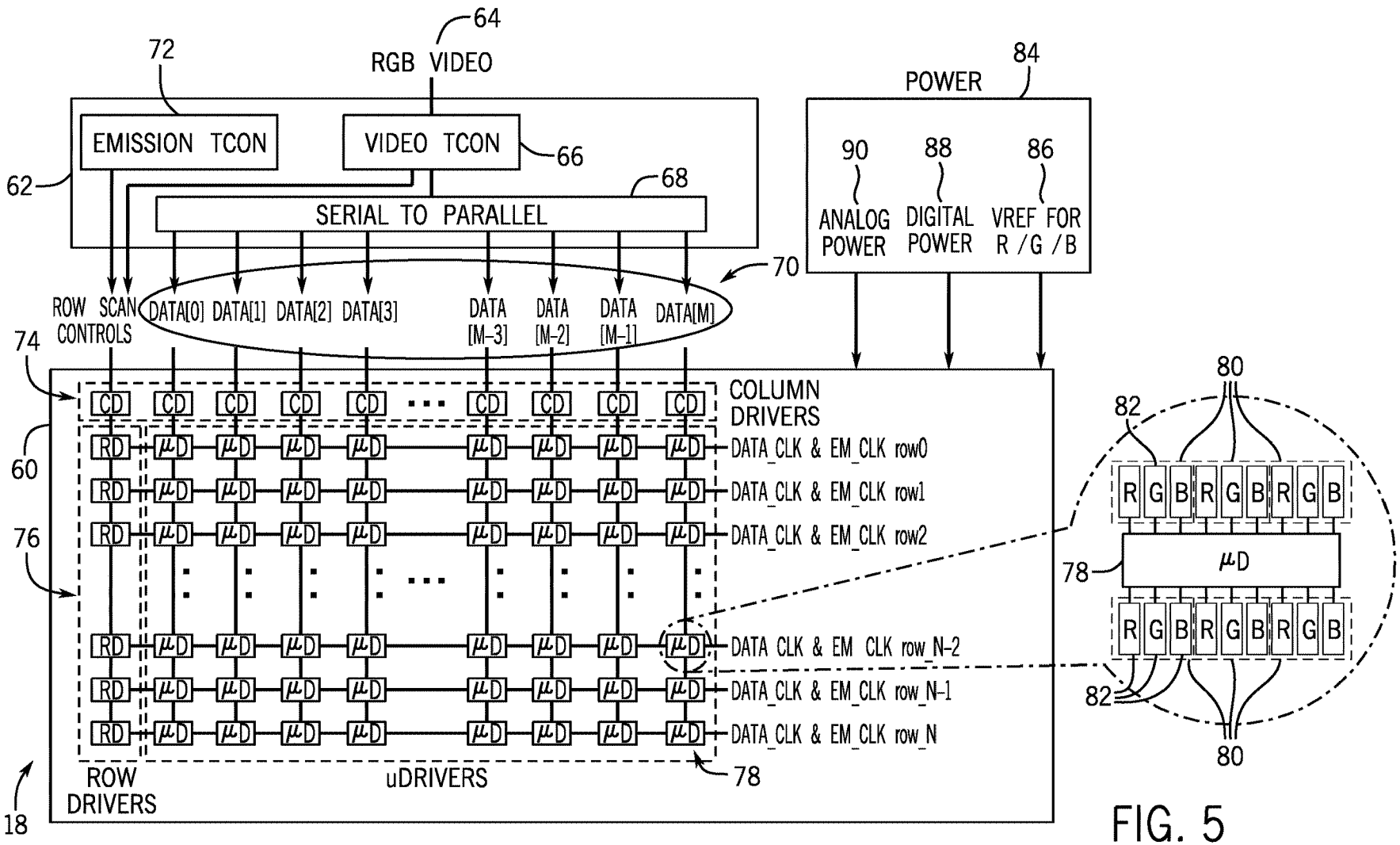
FIG. 5 is a block diagram of a μ-LED display that employs microdrivers (μDs) to drive μ-LED subpixels with controls signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as subpixels. Support circuitry 62 thus may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial signal to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[0], DATA[1], DATA[2], DATA[3] DATA[M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 includes column drivers (CDs) 74, row drivers (RDs) 76, and micro-drivers (μDs or uDs) 78. Each uD 78 drives a number of pixels 80 having μ-LEDs as subpixels 82. Each pixel 80 includes at least one red μ-LED, at least one green μ-LED, and at least one blue μ-LED to represent the image data 64 in RGB format. Although the uDs 78 of FIG. 5 is shown to drive six pixels 80 having three subpixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage (VREF) 86 to drive the μ-LEDs, a digital power signal 88, and an analog power signal 90. In some cases, the power supply 84 may provide more than one reference voltage (VREF) 86 signal. Namely, subpixels 82 of different colors may be driven using different reference voltages. As such, the power supply 84 may provide more than one reference voltage (VREF) 86. Additionally or alternatively, other circuitry on the display panel 60 may step the reference voltage (VREF) 86 up or down to obtain different reference voltages to drive different colors of μ-LED.

To allow the μDs 78 to drive the μ-LED subpixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate to activate the row of μDs 78 driven by the RD 76. A row of uDs 78 may be activated when the RD 76 that controls that row sends the data clock signal (DATA_CLK). This may cause the now-activated uDs 78 of that row to receive and store the digital image data 70 signal that is driven by the column drivers (CDs) 74. The uDs 78 of that row then may drive the pixels 80 based on the stored digital image data 70 signal based on the emission clock signal (EM_CLK).

Figure 6:
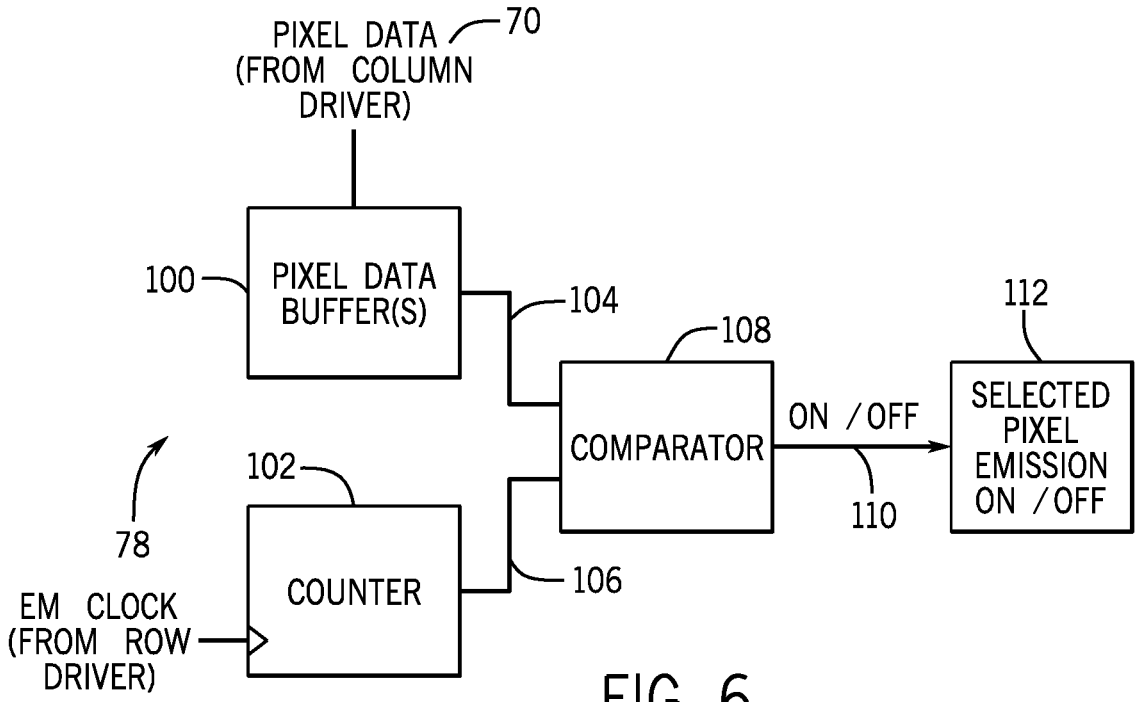
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include pixel data buffers to store image data 70 for three subpixels 82 at any one time (e.g., for 8-bit image data 70, this may be 24 bits of storage). It should be appreciated, however, that the μD 78 may include more or fewer buffers, depending on the data rate of the image data 70 and the number of subpixels 82 included in the image data 70. The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular subpixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the subpixel 82 being driven, which may cause light emission 112 from the selected subpixel 82 to be on or off. The longer the selected subpixel 82 is driven "on" by the emission control signal 110, the greater the amount of light that will be perceived by the human eye as originating from the subpixel 82.

Figure 7:
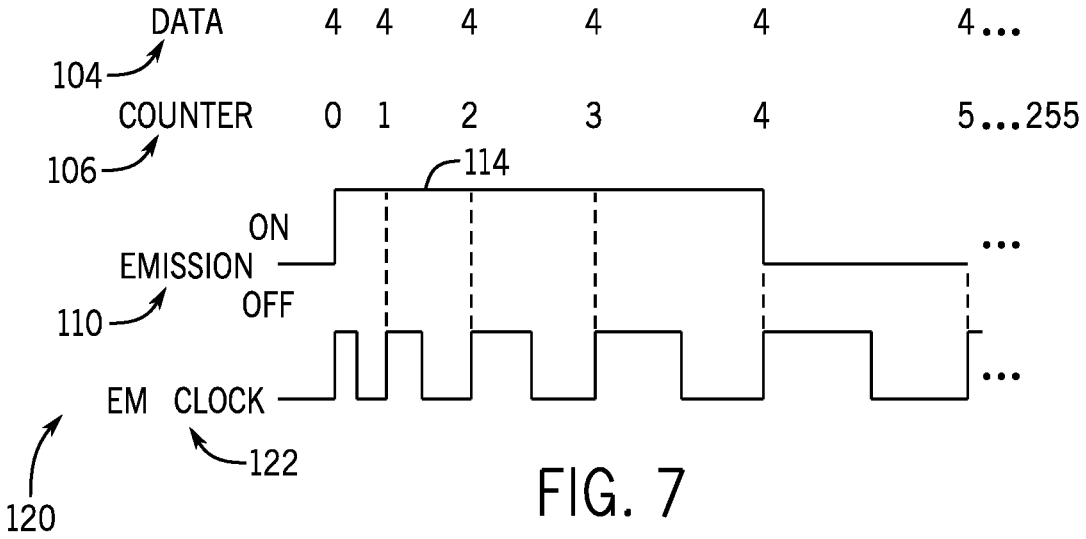
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected subpixel 82 is gray level 4, and this is reflected in the digital data signal 104. The emission control signal 110 drives the subpixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected subpixel 82 no longer to emit light.

It should be noted that the steps between gray levels are reflected by the steps between emission clock signal (EM_CLK) edges. That is, based on the way humans perceive light, to notice the difference between lower gray levels, the difference between the amount of light emitted between two lower gray levels may be relatively small. To notice the difference between higher gray levels, however, the difference between the amount of light emitted between two higher gray levels may be comparatively much greater. The emission clock signal (EM_CLK) therefore may use relatively short time intervals between clock edges at first. To account for the increase in the difference between light emitted as gray levels increase, the differences between edges (e.g., periods) of the emission clock signal (EM_CLK) may gradually lengthen. The particular pattern of the emission clock signal (EM_CLK), as generated by the emission TCON 72, may have increasingly longer differences between edges (e.g., periods) so as to provide a gamma encoding of the gray level of the subpixel 82 being driven.

In some embodiments, voltage (IR) drop may distributed in time and/or space to reduce or remove the appearance of display artifacts resulting from IR drop. The IR drop may refer to an analog IR drop or a digital IR drop. Analog IR drop is at a low frequency due to the current through the passing through the micro light emitting diodes. Digital IR drop refers to an IR drop caused by digital switching (e.g., emission scanning). One or more of the IR drops may be distributed throughout the display geographically and/or temporally. For example, multiple emission phases may be used to control when and where the display is emitting light.

Figure 8:
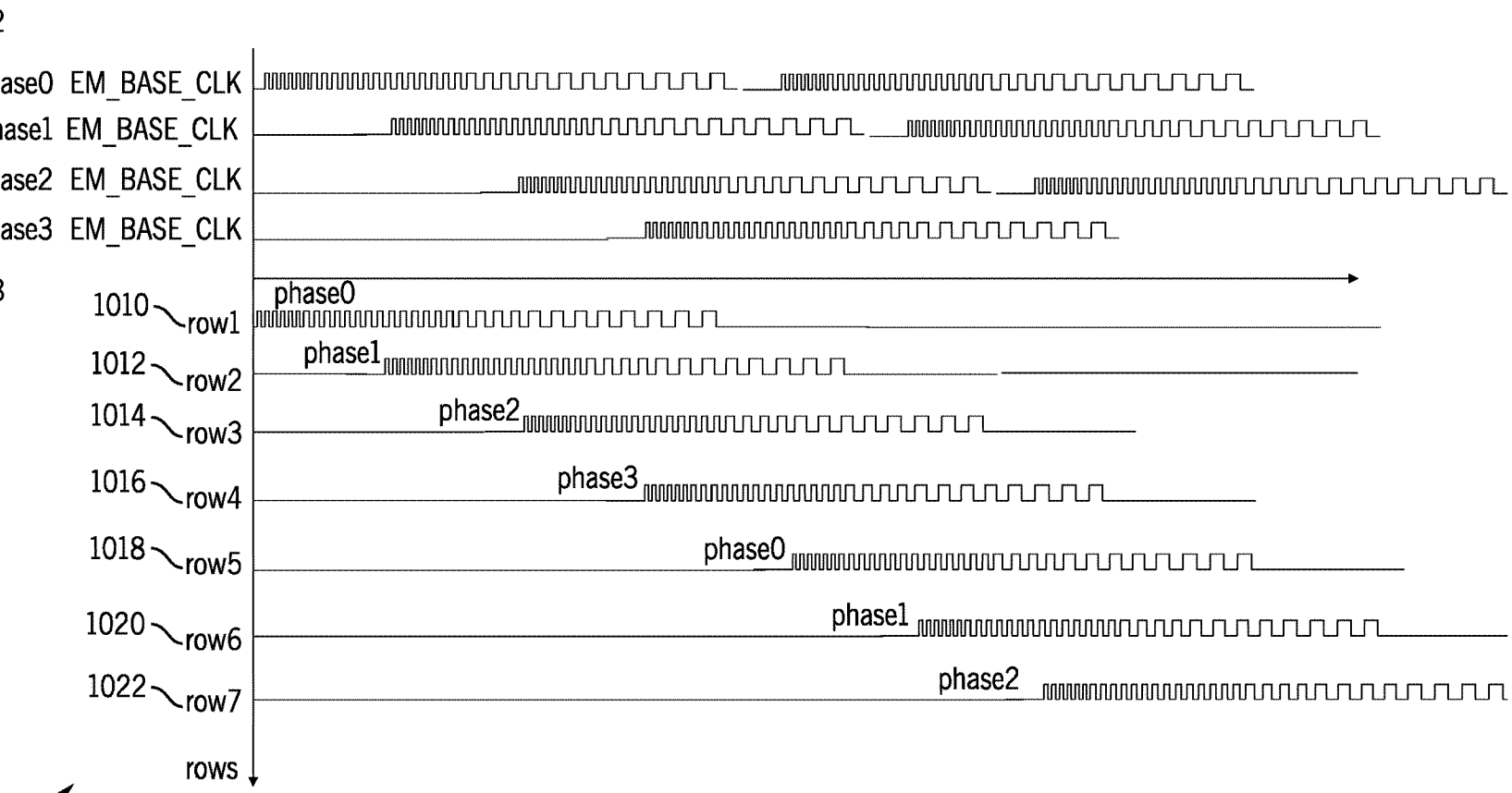
FIG. 8 is a timing diagram with four emission clock phases, in accordance with an embodiment.

FIG. 8 illustrates a timing diagram 1000 that includes a phase 0 emission clock 1002, a phase 1 emission clock 1004, a phase 2 emission clock 1006, and a phase 3 emission clock 1008. Although the timing diagram 1000 includes four phases, the electronic display may use more or less phases. For example, the electronic display may include 2, 3, 4, 5, 6, or more phases for the emission clock. These phases or "base clocks" are generated in the emission TCON 72 or the video TCON 66. Each row driver in the display elects one of the phases. The timing diagram 1000 illustrates that a first row 1010 uses the phase 0 emission clock 1002, a second row 1012 uses the phase 1 emission clock 1004, a third row 1014 uses the phase 2 emission clock 1006, a fourth row 1016 uses the phase 3 emission clock, a fifth row 1018 that uses the phase 0 emission clock 1002, a sixth row 1020 that uses the phase 1 emission clock 1002, and a seventh row the uses the phase 2 emission clock 1002. As illustrated, the emission clock may be in an initialization state where, each row adopts its phase in sequence, but the phase of the row may be derived based on the number of base clock phases used and the number of the row. Essentially, each row uses a phase selected using the following formula:

$$Phase_{EM_CLK} = \frac{\text{Row}}{N_{EM_CLK}} - 1 \qquad \text{(Equation 1)}$$

where PhaseEM_CLK is the phase for of emission clock for a row (e.g., Phase 0); Row is the row for which the phase is being determined, and NEM_CLK is the number of phases available (e.g., 4). Thus, any row driver may determine its phase to use based on how many rows are located before the row. The rows may be numbered in a top-to-bottom or bottom-to-top order. Furthermore, the row drivers and column driver tasks may be reversed and all discussion related to rows may refer to columns and vice versa. Thus, the columns may be driven at different emission levels or times based on time, as discussed herein.

Figure 9:
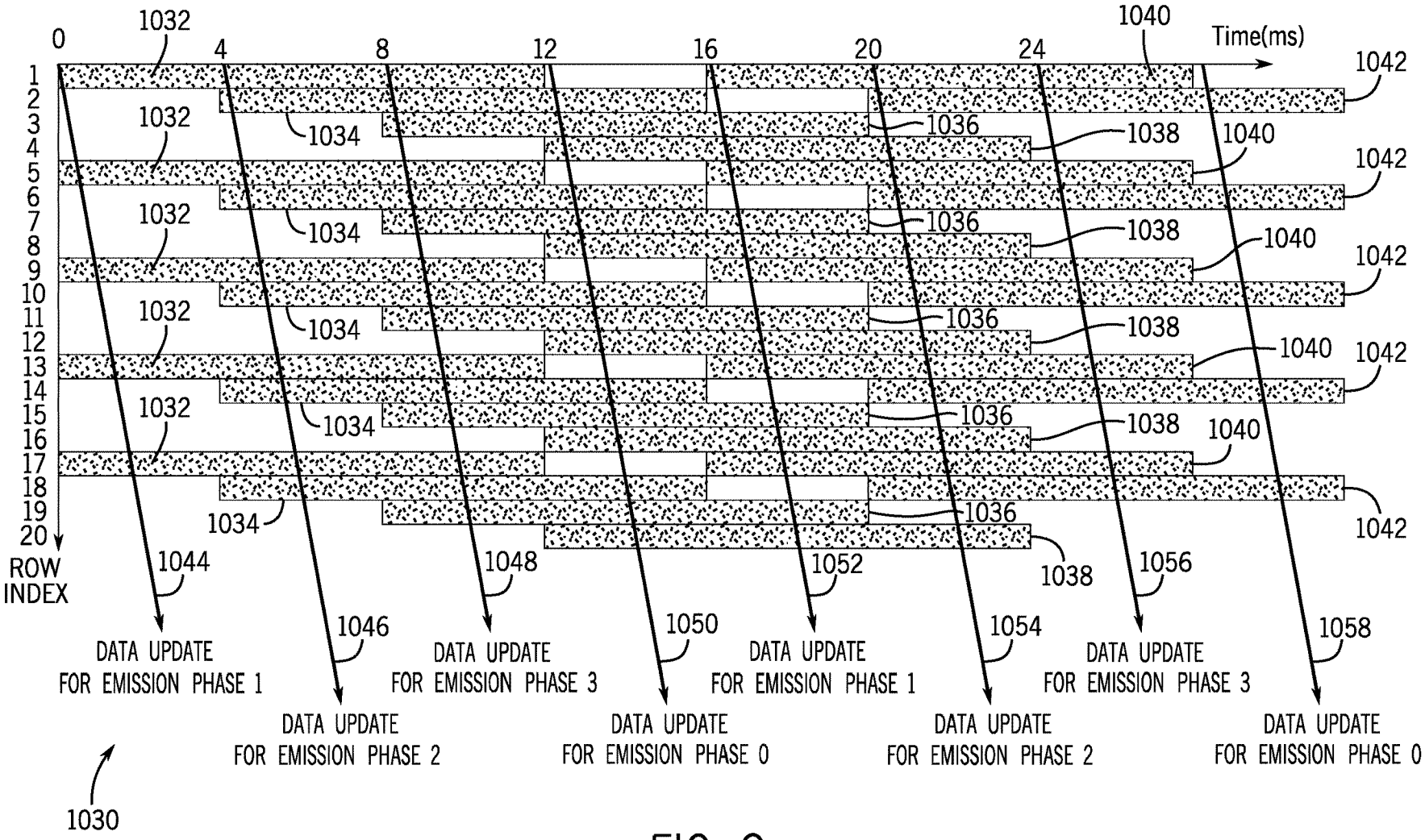
FIG. 9 is a timing diagram of the four emission clock phases of FIG. 8 illustrating emission states and related data updates, in accordance with an embodiment.

As previously discussed, a data update and the emission phase may be performed at different times due to the pixel data buffers in the microdrivers. FIG. 9 illustrates a timing diagram 1030 that illustrates an emission phase and its related data update. The timing diagram 1030 shows an emission state for each row when the duty cycle is relatively high (e.g., solid white) and four phases. A first cycle of a first phase 1032 is used at rows 1, 5, 9, 13, and 17, a first cycle of a second phase 1034 is used at rows 2, 6, 10, 14, and 18, a first cycle of a third phase 1036 is for rows 3, 7, 15, and 19; and a first cycle of a fourth phase 1038 is used for rows 4, 8, 16, and 20. Once a cycle (e.g., 16 milliseconds for a 60 Hz refresh rate) has been completed, the phases repeat. For example, a second cycle of the first phase 1040 begins for rows 1, 5, 9, 13, and 17 at the beginning of the new cycle and, a second cycle of the second phase 1042 begins for rows after 1/N of the cycle has been completed when N is the number of phase base clocks used.

The timing diagram 1030 also illustrates data updates 1044, 1046, 1048, 1050, 1052, 1054, 1056, and 1058 used to update pixel data to the microdrivers. The data update may be updated prior to emission of the data via the emission clock phases. For example, the data update 1044 includes an update for rows using the first cycle 1034 of the phase 1 signals, and the data update 1046 includes an update for rows using the first cycle 1036 phase 2 signals, the data update 1048 includes an update for rows using the first cycle 1038 of the phase 3 signals, the data update 1050 includes an update for rows using the phase 0 signal second cycle 1040, the data update 1052 includes an update for rows using the phase 1 signal second cycle 1042, the data update 1054 includes an update for rows using a second cycle of the phase 2 signal, the data update 1056 includes an update for rows using a second cycle of the phase 3 signal, and the data update 1058 includes an update for rows using a third cycle of the phase 3 signal. Thus, the data update may be provided before emission of the data provided in the update.

By distributing emission and data updates, IR drop may be distributed and smoothed from row to row. In other words, luminance drops between rows may be eliminated or reduced. Furthermore, such distribution may be completed using a relatively low number of clock phases (e.g., 4 or 6 phases), but the distribution may be more complete with more clock phases. Since rows and columns are selectable, the illustrated distribution may be implemented on local passive matrices by programming shift registers to behave differently by shifting emission for adjacent rows.

Figure 10:
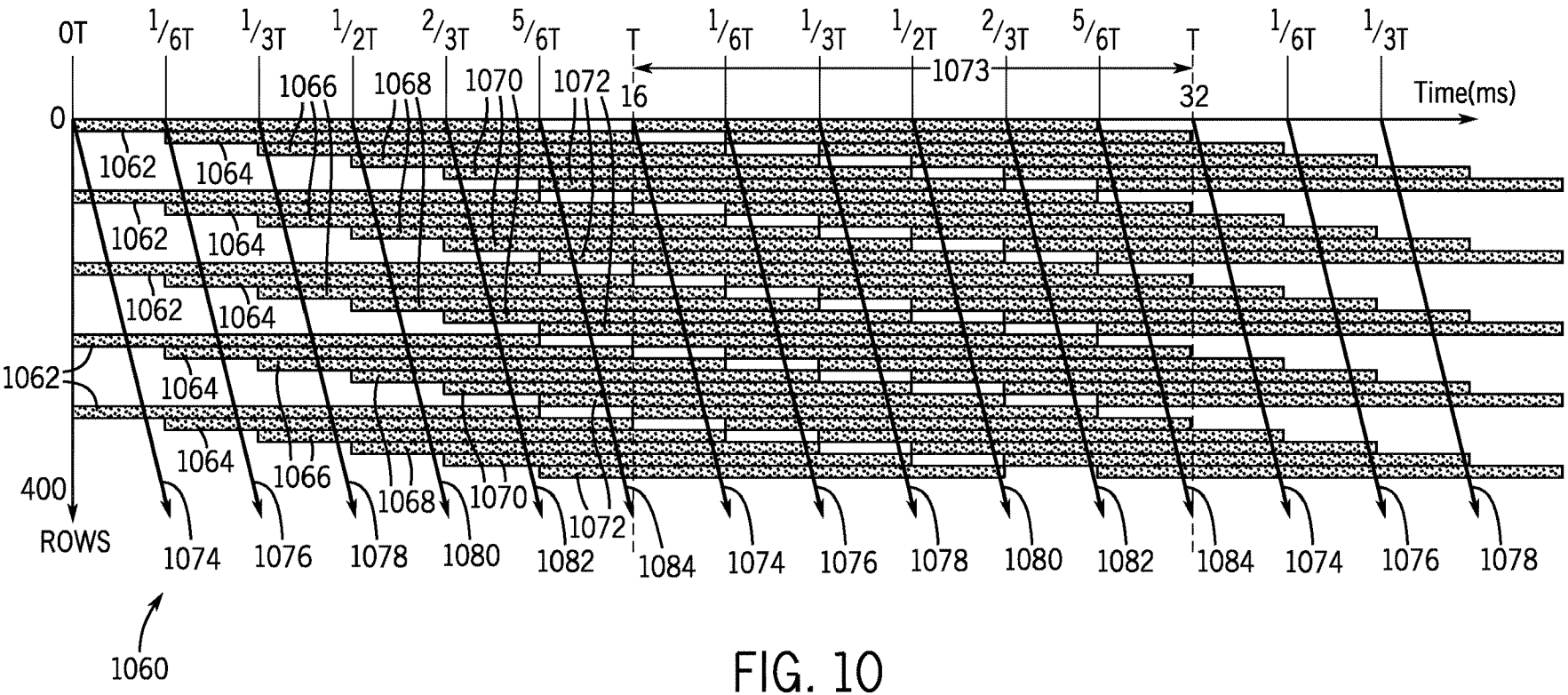
FIG. 10 is a timing diagram with an emission distribution having six emission clock phases, in accordance with an embodiment.

FIG. 10 illustrates a timing diagram 1060 with an emission distribution using 6 phases. The timing diagram illustrates a first clock phase 1062 used by rows 1, 7, 13, 19, 25, and so on; a second clock phase 1064 used by rows 2, 8, 14, 20, 26, and so on; a third clock phase 1066 used by rows 3, 9, 15, 21, 27, and so on; a fourth clock phase 1068 used by rows 4, 10, 16, 22, 28, and so on; a fifth clock phase 1070 used by rows 5, 11, 17, 23, 29, and so on; and a sixth clock phase 1072 used by rows 6, 12, 18, 24, 30, and so on. Data updates also occur at T=1/N (e.g., 1/6) of a period 1073 of an emission scan. For example, at OT, a first data update 1074 is sent to rows (2, 8, 14, 20, 26, and so on) using the phase 1 clock 1064; a second data update 1076 is sent to rows using the phase 2 clock 1066 at 1/6T, a third data update 1078 is sent to rows using the phase 3 clock 1068 at 1/3T, a fourth data update 1078 is sent to rows using the phase 4 clock 1068 at 1/2T, a fifth data update 1080 is sent to rows using the phase 5 clock 1070 at 2/3T, and a sixth data update 1082 is sent to rows using the phase 0 clock 1072 at 5/6T. After a period T has elapsed, the emission sequence and data update pattern begin again.

Figure 11:
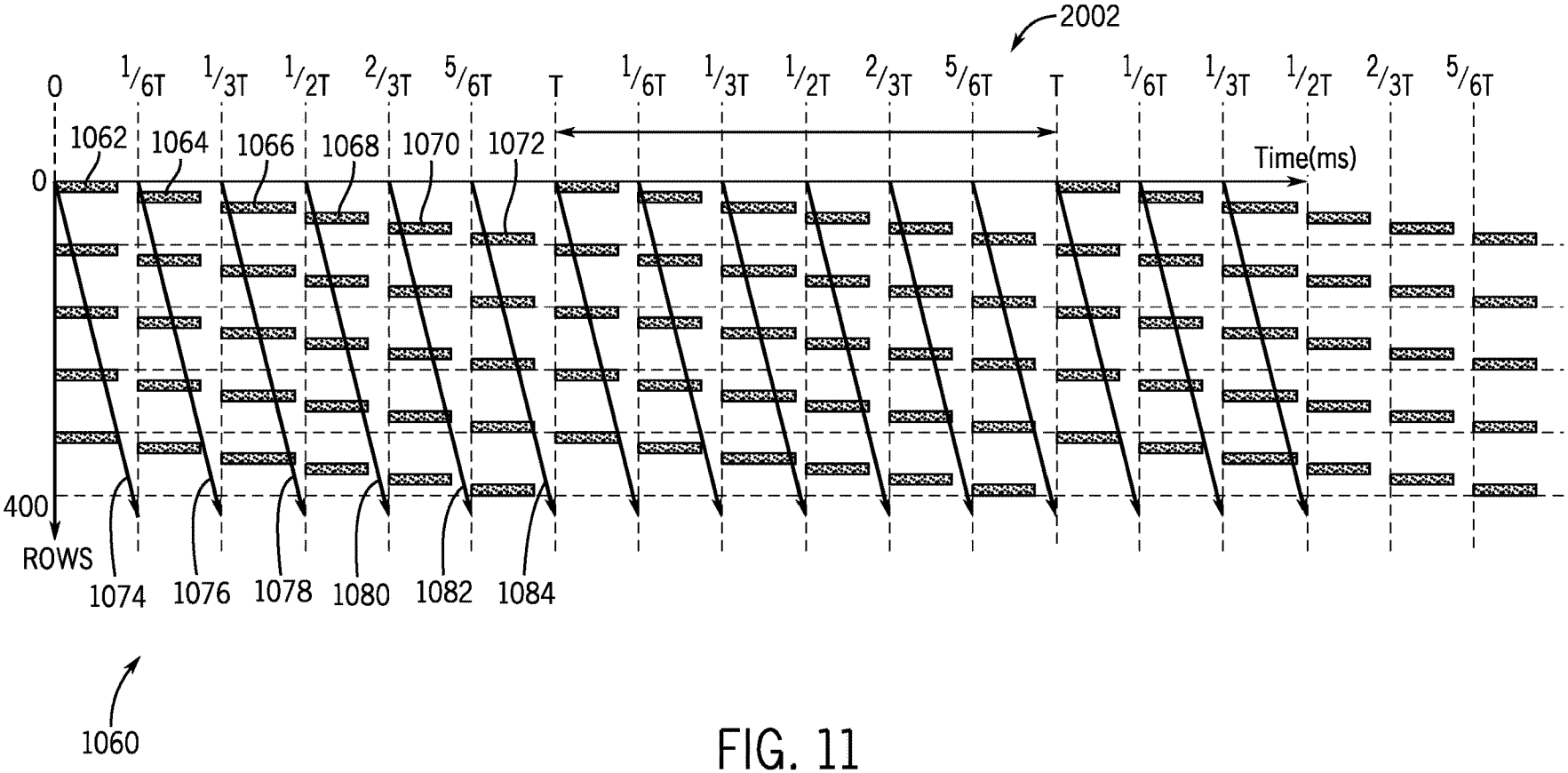
FIG. 11 is a timing diagram with an emission distribution having six emission clock phases with a relatively low duty cycle, in accordance with an embodiment.
Figure 12:
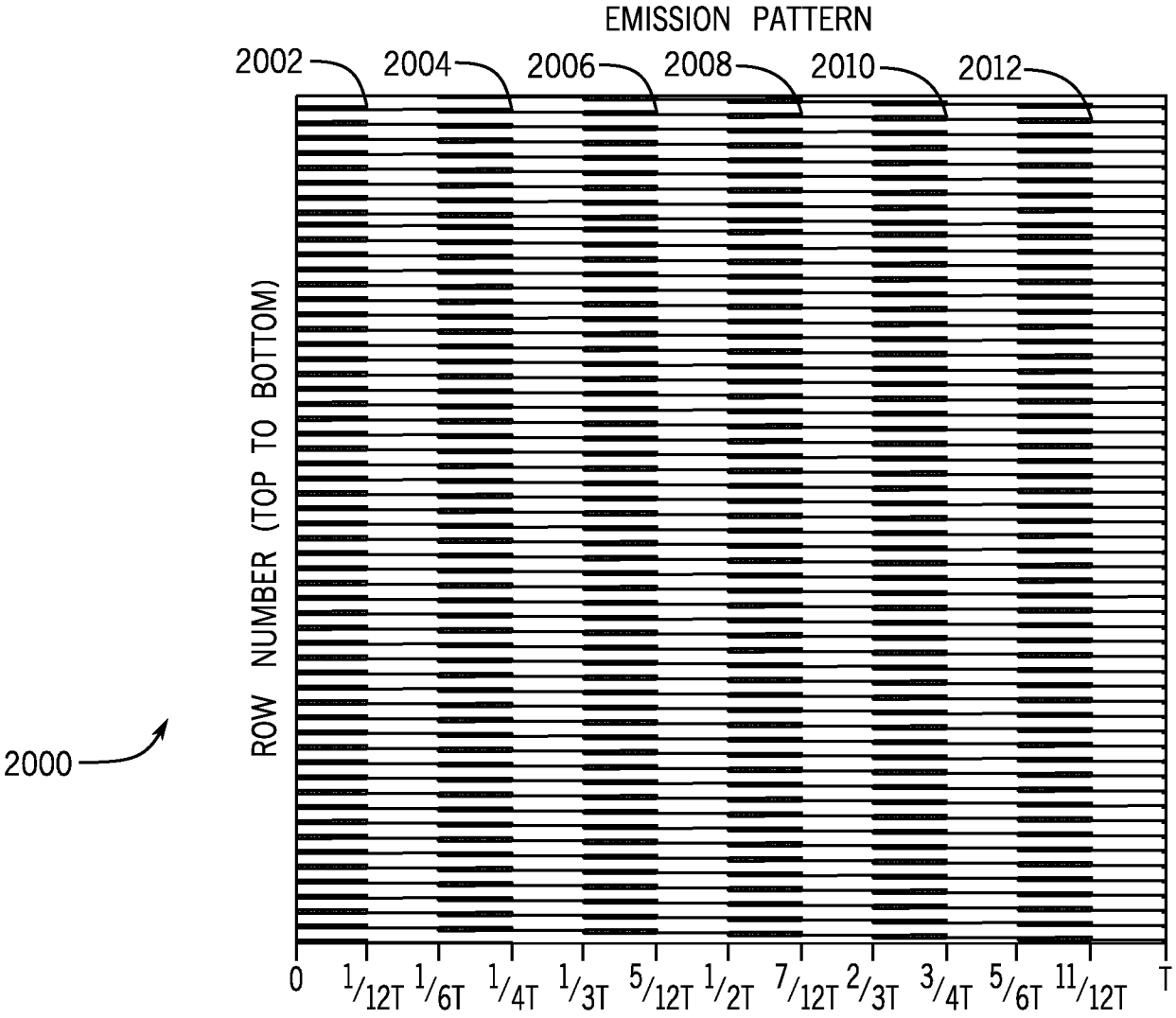
FIG. 12 is an emission patter using six phases and a duty cycle of 75%, in accordance with an embodiment.
Figure 13:
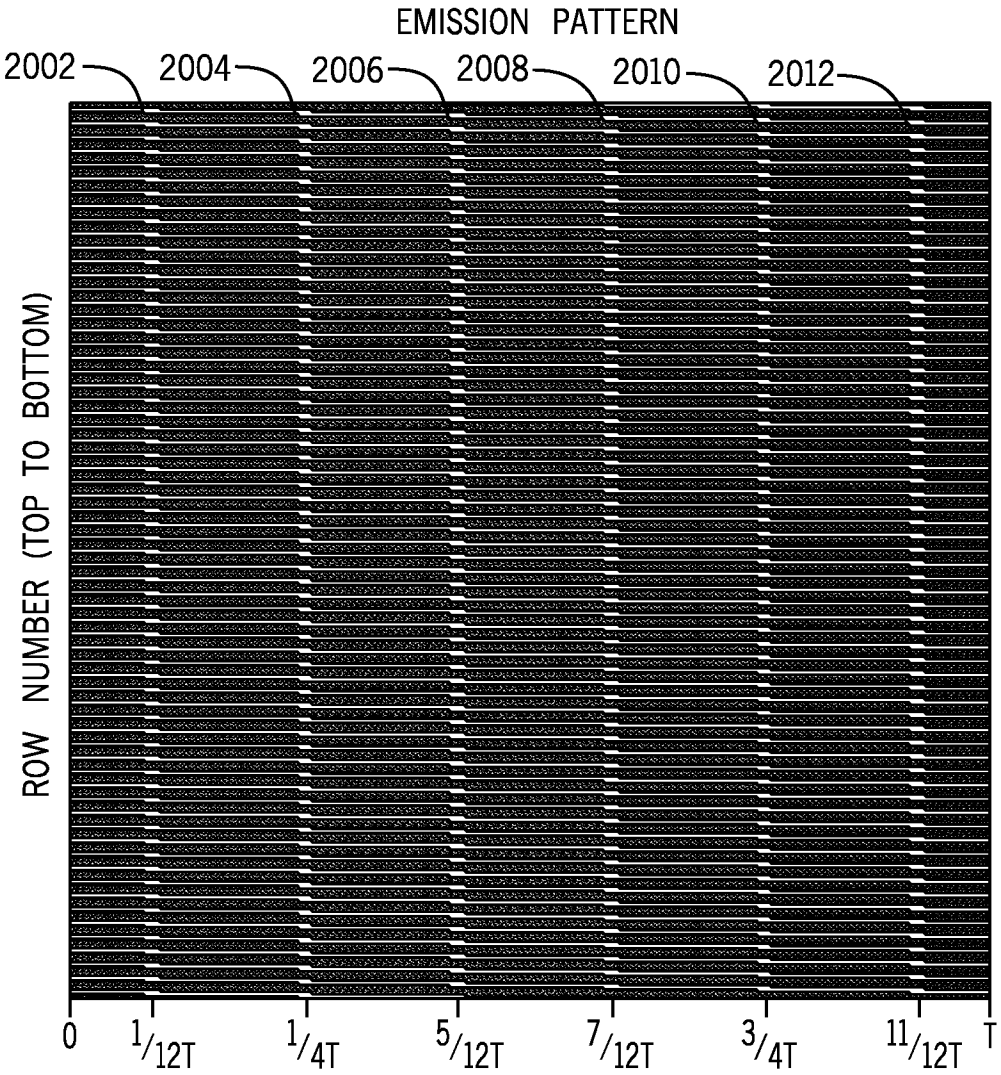
FIG. 13 is an emission patter using six phases and a duty cycle of 35%, in accordance with an embodiment.

FIG. 11 illustrates the timing diagram 1060 with a relatively low duty cycle (e.g., low gray level). In other words, the emission period for each row in the emission scan is a relatively small portion of a possible emission period. FIG. 12 illustrates an emission pattern 2000 using 6 phases for a display and a duty cycle of 75% for a single period. Rows 2002 using phase 0 clocks begin at 1/12T, rows 2004 using phase 1 clocks begin at 1/4T, rows 2006 using phase 2 clocks begin at 5/12T, rows 2008 using phase 3 clocks begin at 7/12T, rows 2010 using phase 4 clocks begin at 3/4T, and rows 2012 using phase 5 clocks begin at 11/12T. FIG. 13 illustrates the emission pattern 2000 with 6 phases and a relatively low duty cycle of 35%. As can be seen, a higher duty cycle results in more overlap of the emission period of the pixels of the rows.

Figure 14:
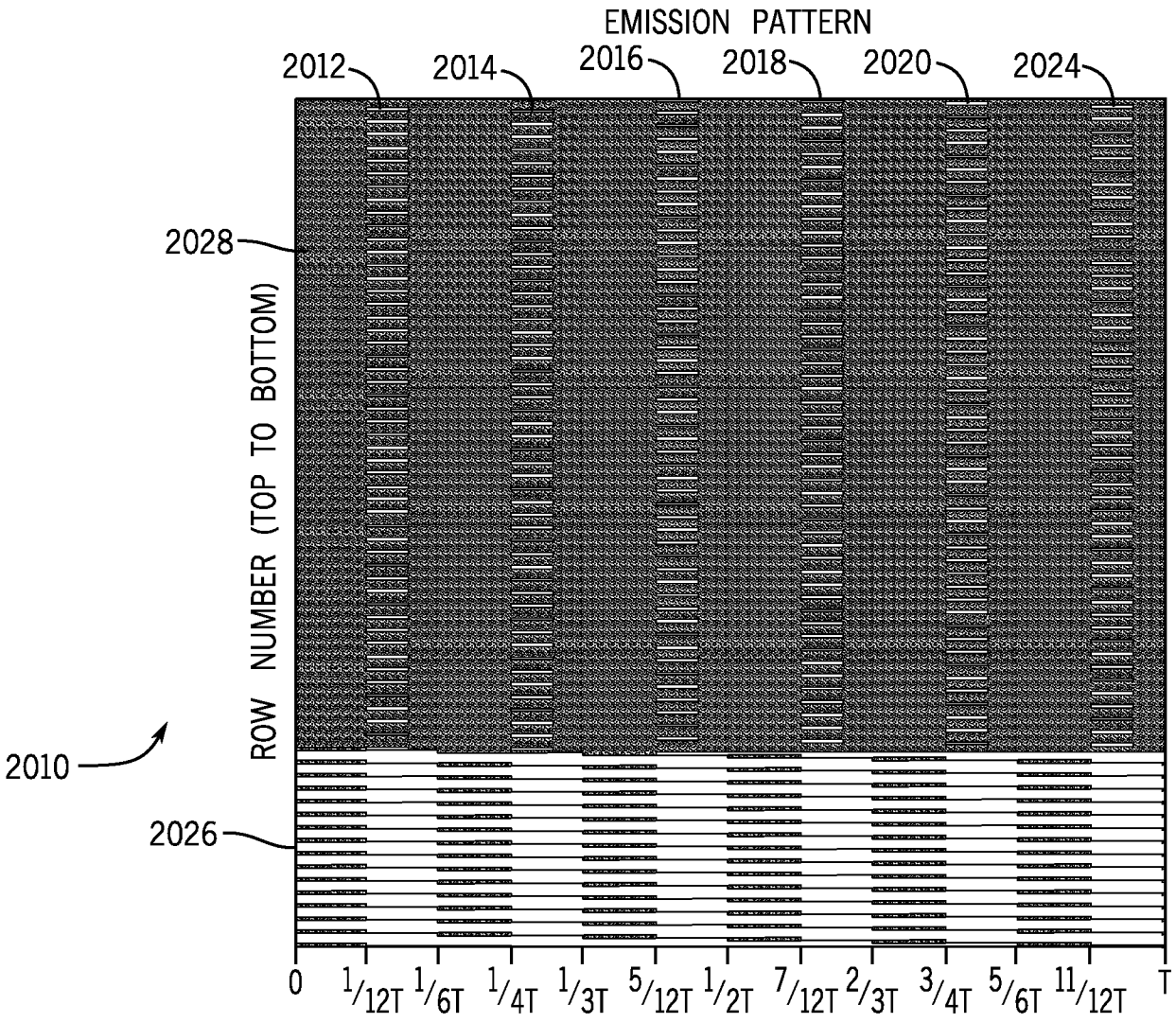
FIG. 14 is an emission patter using six phases and a duty cycle that varies by row, in accordance with an embodiment.

FIG. 14 illustrates a combined content emission pattern 2010. The content emission pattern 2010 uses 6 phases. Rows 2012 using phase 0 clocks begin at 1/12T, rows 2014 using phase 1 clocks begin at 1/4T, rows 2016 using phase 2 clocks begin at 5/12T, rows 2018 using phase 3 clocks begin at 7/12T, rows 2020 using phase 4 clocks begin at 3/4T, and rows 2014 using phase 5 clocks begin at 11/12T. A lower portion 2026 of the content includes relatively high gray levels (e.g., 75% duty cycle), and an upper portion 2028 of the content includes relatively low gray levels (e.g., 5% duty cycle).

Figure 15:
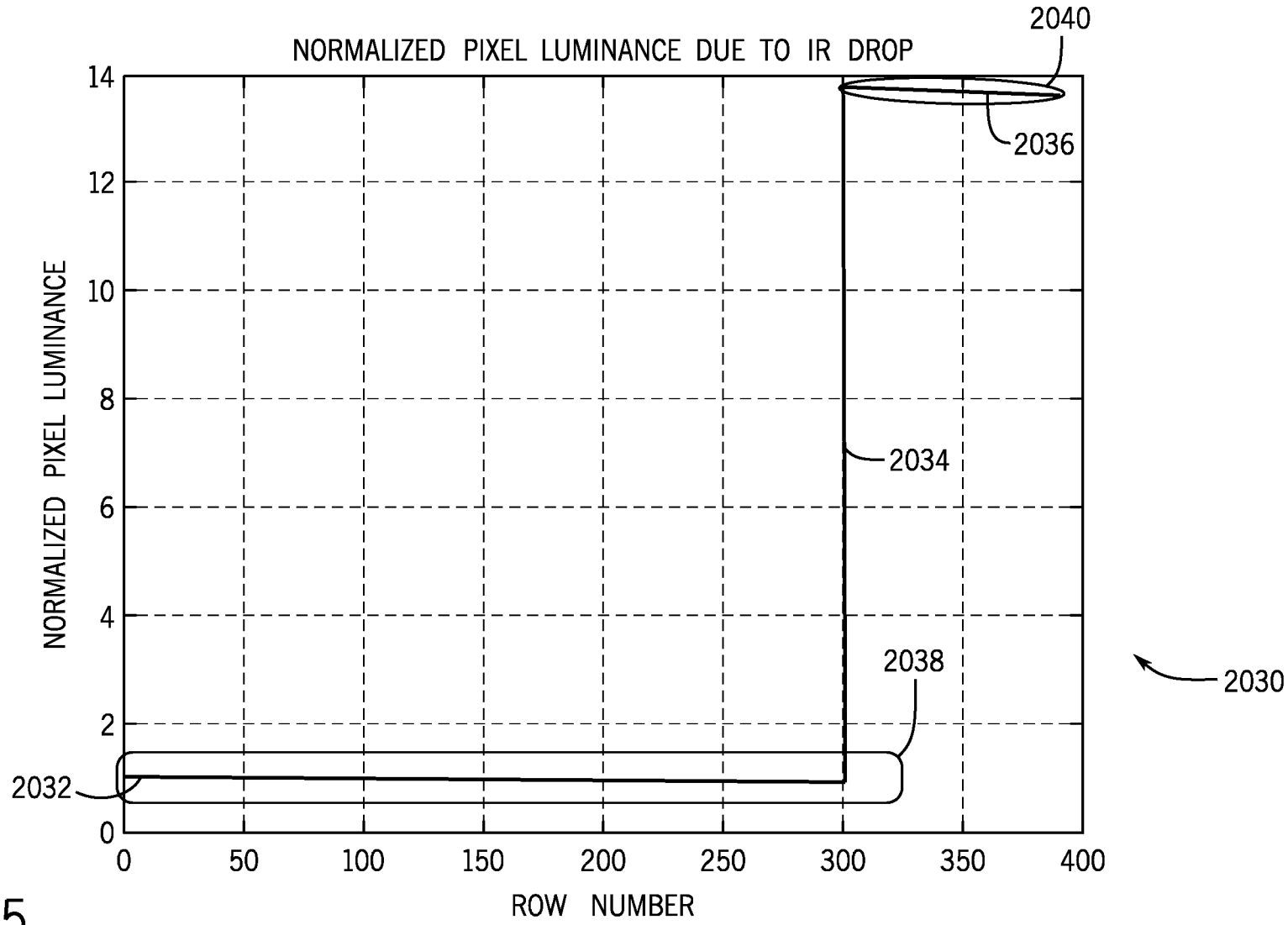
FIG. 15 illustrates a graph of normalized luminance for the content of FIG. 14, in accordance with an embodiment.
Figure 16:
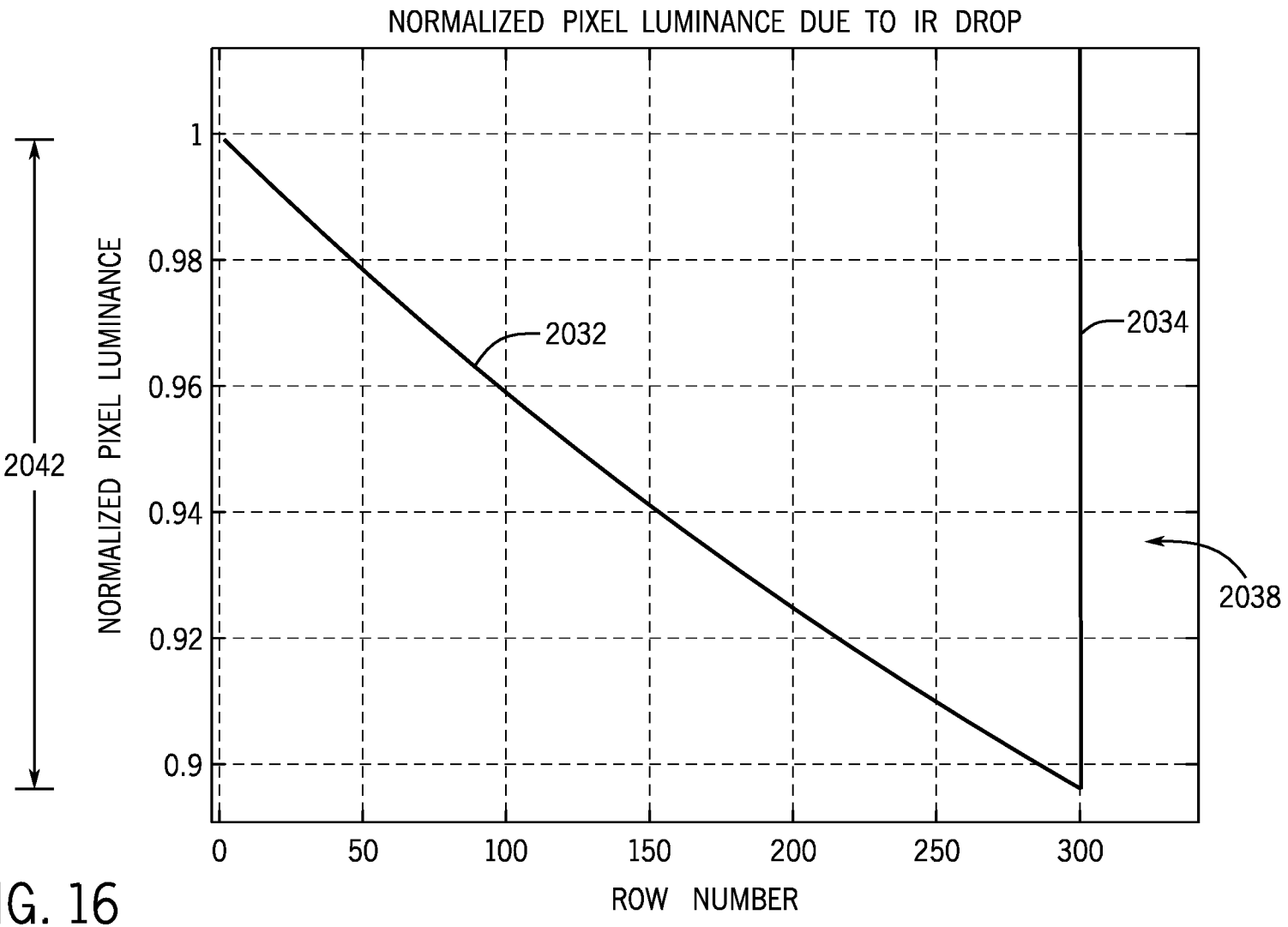
FIG. 16 illustrates a re-scaled view of the graph of FIG. 15 emphasizing IR drop, in accordance with an embodiment.

FIG. 15 illustrates a graph 2030 of normalized pixel luminance for the combined content emission pattern 2010 of FIG. 14. As the graph 2030 illustrates, the luminance of the pixels is generally consistent in a lower flatter region 2032 that includes rows 0 to 300. At row 300, the luminance encounters a luminance spike 2034 as the content transitions from lighter to darker values. Below the luminance spike 2034 on the display, the luminance of the pixels settles into a consistent higher flatter region 2036. Although the lower flatter region 2032 and the upper flatter region 2036 appear primarily flat, some vertical variance appears in a lower plateau region 2038 and an upper plateau region 2040. FIG. 16 illustrates a scaled view of the lower plateau region 2038 accentuating an luminance drop 2042 that may be at least partially attributed to IR drop due to digital switching using traditional emission scanning. The example luminance drop includes a drop in luminance of about 12%.

Figure 17:
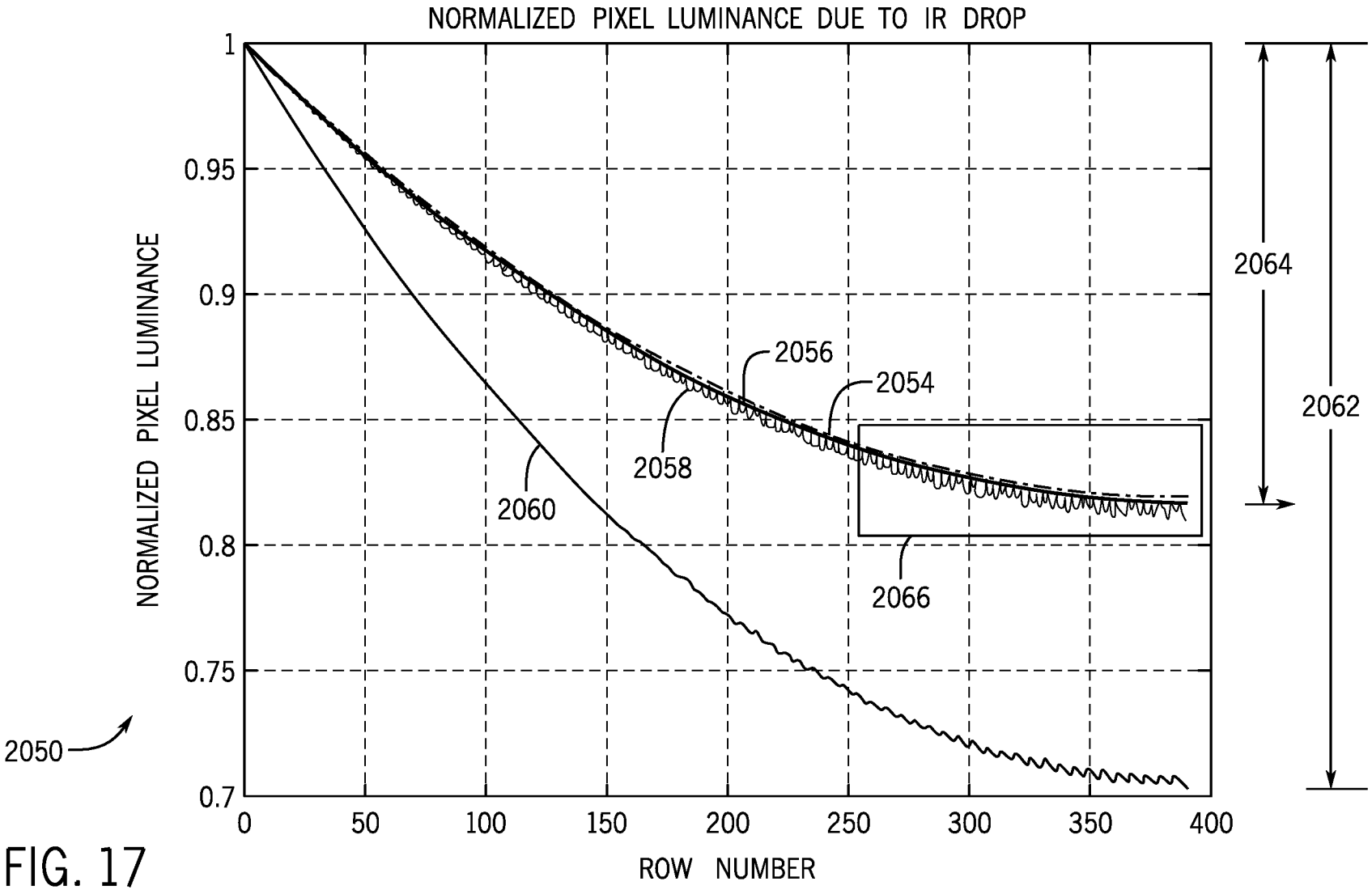
FIG. 17 illustrates a graph of normalized luminance with distributed emission periods, in accordance with an embodiment.
Figure 18:
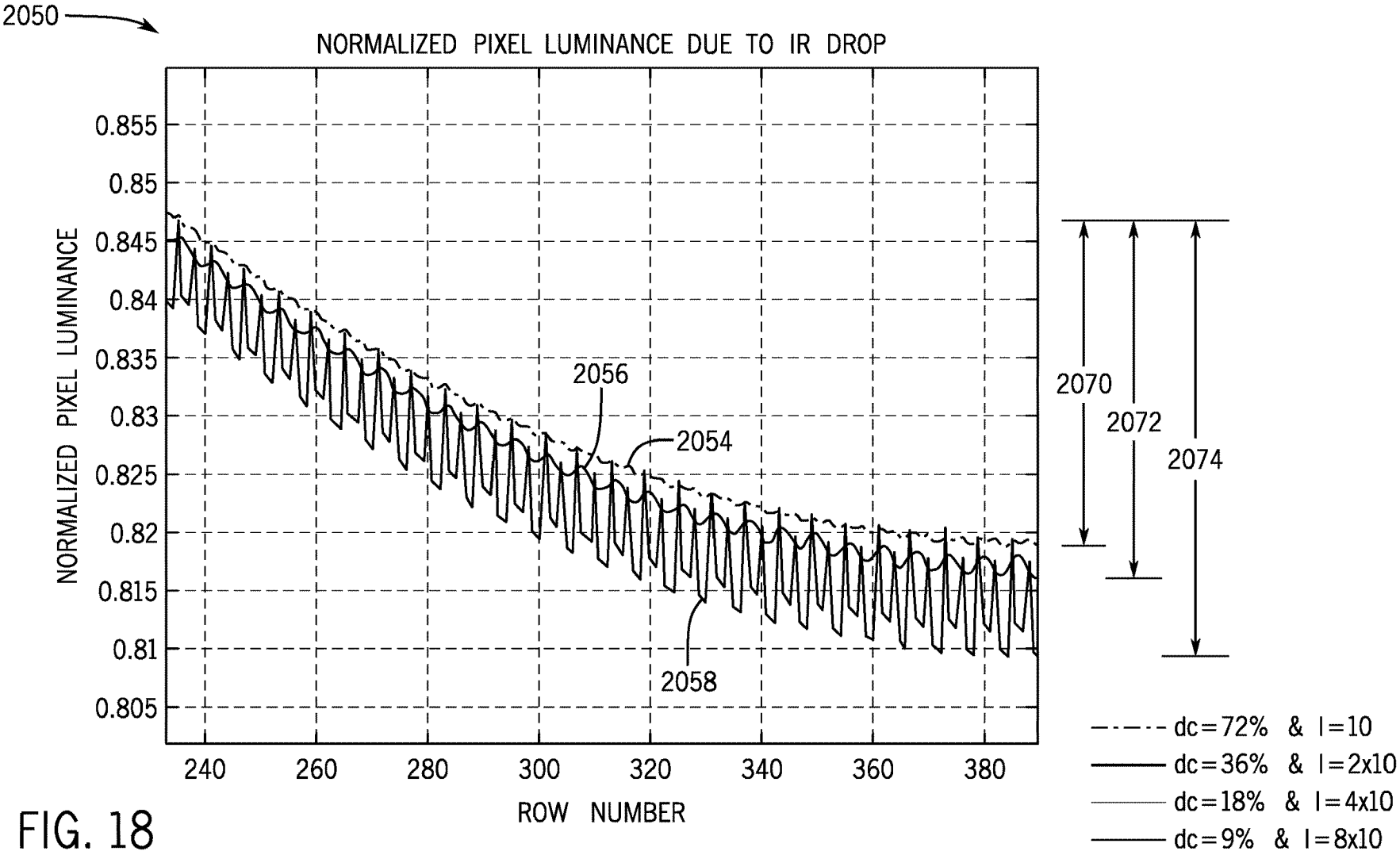
FIG. 18 illustrates a re-scaled view of the graph of FIG. 17 emphasizing IR drop, in accordance with an embodiment.

FIG. 17 illustrates a graph 2050 of luminance drops resulting from the spatially varying emission scan discussed herein. The graph 2050 includes four luminance drop graphs all having the same number of phases (e.g., 6), but each graph has a different current and duty cycle combination. For instance, a first line 2054 corresponds to a luminance drop with a first current in the microdriver and a related duty cycle (e.g., 72%). A second line 2056 corresponds to a half-duty cycle (e.g., 36%) and double current. A third line 2058 corresponds to a quarter duty cycle (e.g., 18%) and quadruple the current. A fourth line 2060 corresponds to an eighth duty cycle (e.g., 9%) and eight times the current. As illustrated, the fourth line 2060 with the highest current has the greatest luminance drop 2062, but the remaining lines 2054, 2056, and 2058 substantially share a luminance drop 2064. A region of interest 2066 is re-scaled in FIG. 18. FIG. 18 is a re-scaled and zoomed view of the graph 2050 illustrating the differences between lines 2054, 2056, and 2058. As illustrated, the line 2054 (with the largest duty cycle and lowest current) includes a relatively low luminance drop 2070, the line 2056 (with the medium duty cycle and medium current) corresponds to a medium luminance drop 2072, and the line 2058 (with the smallest duty cycle and highest current) corresponds to a relatively high luminance drop 2074. Thus, the overall luminance drop is related to duty cycle and microdriver current.

Figure 19:
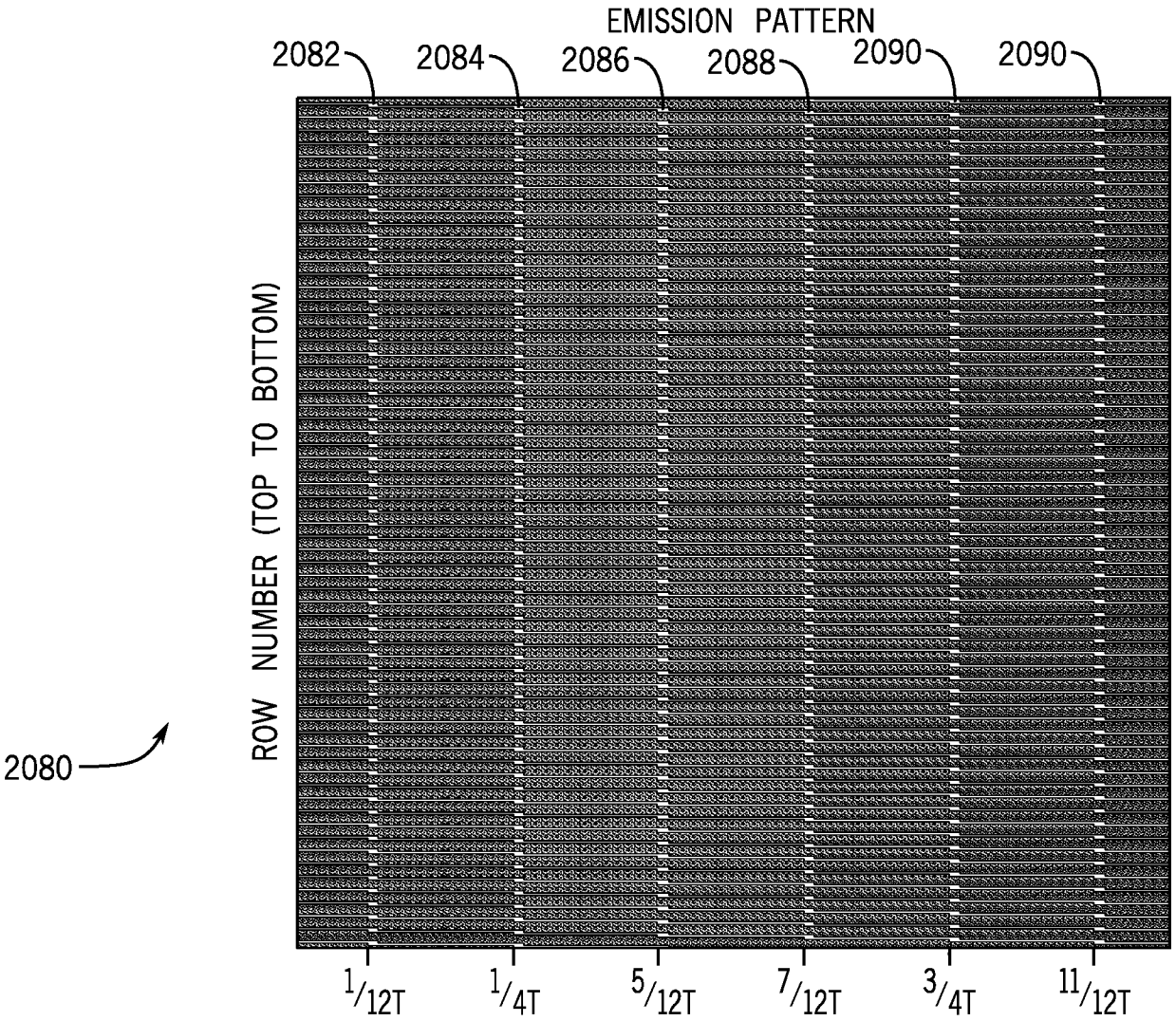
FIG. 19 illustrates an emission pattern of content using a relatively high duty cycle, in accordance with an embodiment.
Figure 20:
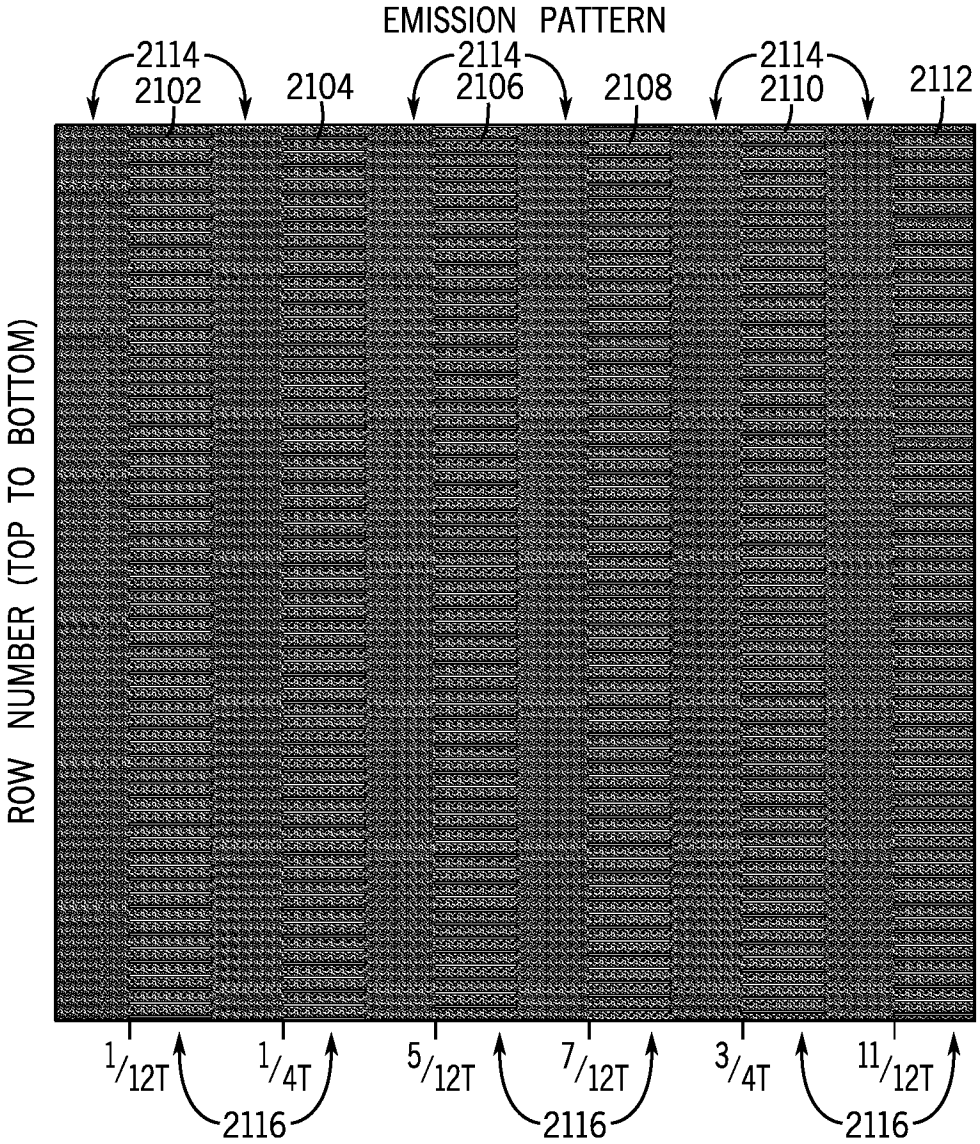
FIG. 20 illustrates an emission pattern of the content of FIG. 19 using a relatively low duty cycle, in accordance with an embodiment.

FIG. 19 illustrates an emission pattern 2080 corresponding to the line 2058. The emission pattern 2080 includes six phases causing six emission periods 2082, 2084, 2086, 2088, 2090, and 2092. As illustrated, current draw is substantially consistently distributed throughout the display during the emission phase. FIG. 20 illustrates an emission pattern 2100 corresponding to a similar display of content using double current and half-duty cycle compared to the emission pattern 2080 of FIG. 19. The emission pattern 2100 includes six phases causing six emission periods 2102, 2104, 2106, 2108, 2110, and 2112. In contrast to the emission pattern 2080, the emission pattern 2100 includes current-less periods 2114 of no current being drawn by any rows and relatively high current periods 2116 with relatively high levels of current being drawn. These strong contrasts (and the resultant switching) may increase likelihood of apparent artifacts resulting from IR drop.

Figure 21:
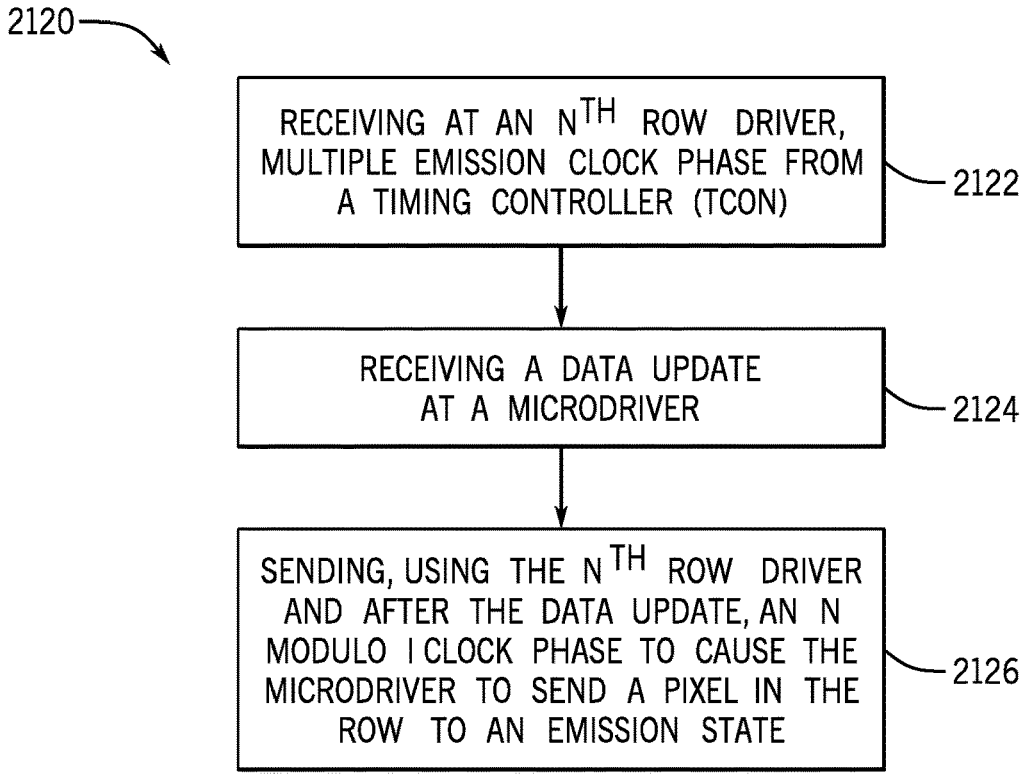
FIG. 21 illustrates a flowchart diagram for reducing IR drop by distributing emission periods throughout the display and distributing the emission periods over time, in accordance with an embodiment.

FIG. 21 illustrates a process 2120 for reducing IR drop artifacts by distributing emission periods throughout the display and distributing the emission periods over time. The process 2120 includes receiving, at an nth row driver out of number of row drivers, multiple emission clock phases from a timing controller (block 2122). A microdriver in a row corresponding to the row driver receives a data update for pixels (block 2124). In some embodiments, the data update may be received from a column driver for the pixels. The row driver sends, after the data update, an n modulo i clock phase to cause the receiving microdriver to send a pixel in the row into an emission state where n is the row and i is the number of clock phases available (block 2126). For example, when there are six emission clock phases, the seventh row may use the first emission clock phase while the tenth row may use the fourth emission clock phase.

Figure 22:
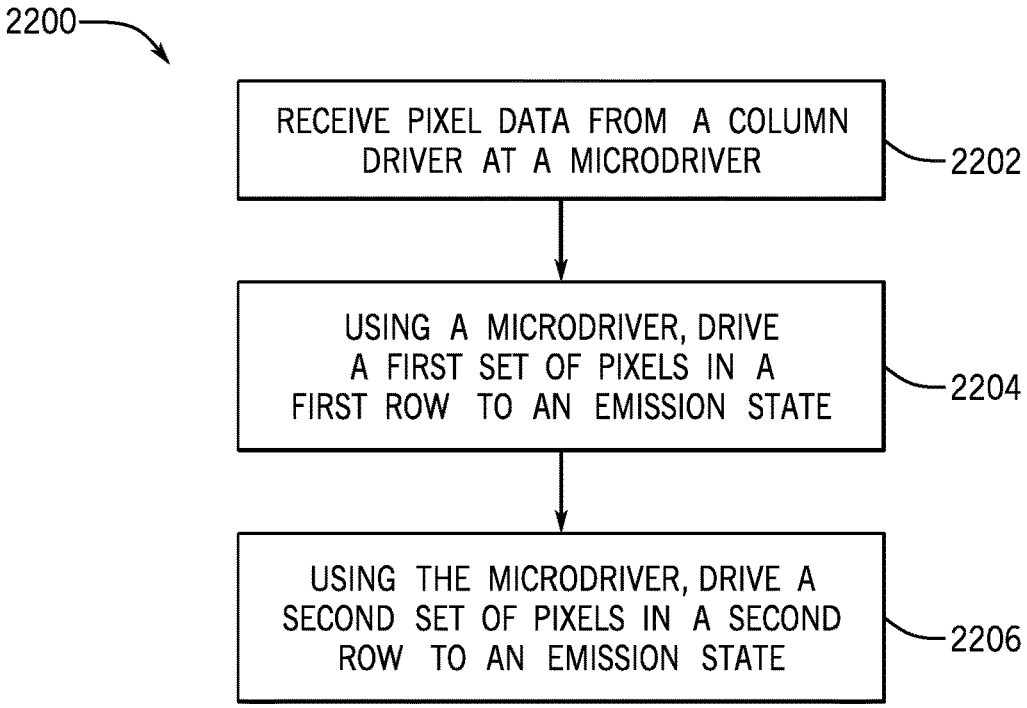
FIG. 22 illustrates a process for operating a display using microdrivers, in accordance with an embodiment.

Since row driving is distributed in time and space, some time-multiplexing may be used to drive more pixels using a single microprocessor without substantially increasing hardware in the microprocessor. FIG. 22 illustrates an embodiment of a process 2200 for operating a display. The process 2200 includes receiving pixel data at a microdriver (block 2202). The pixel data may be received from a row driver or column driver to be stored in the microdriver for display via one or more pixels controlled by the microdriver during an emission period for the pixels. The microdriver then drives a first set of pixels in a first row to an emission state during a first period (block 2204). After the first period, the microdriver drives a second set of pixels in a second row to the emission state during a second period (block 2206).

Figure 23:
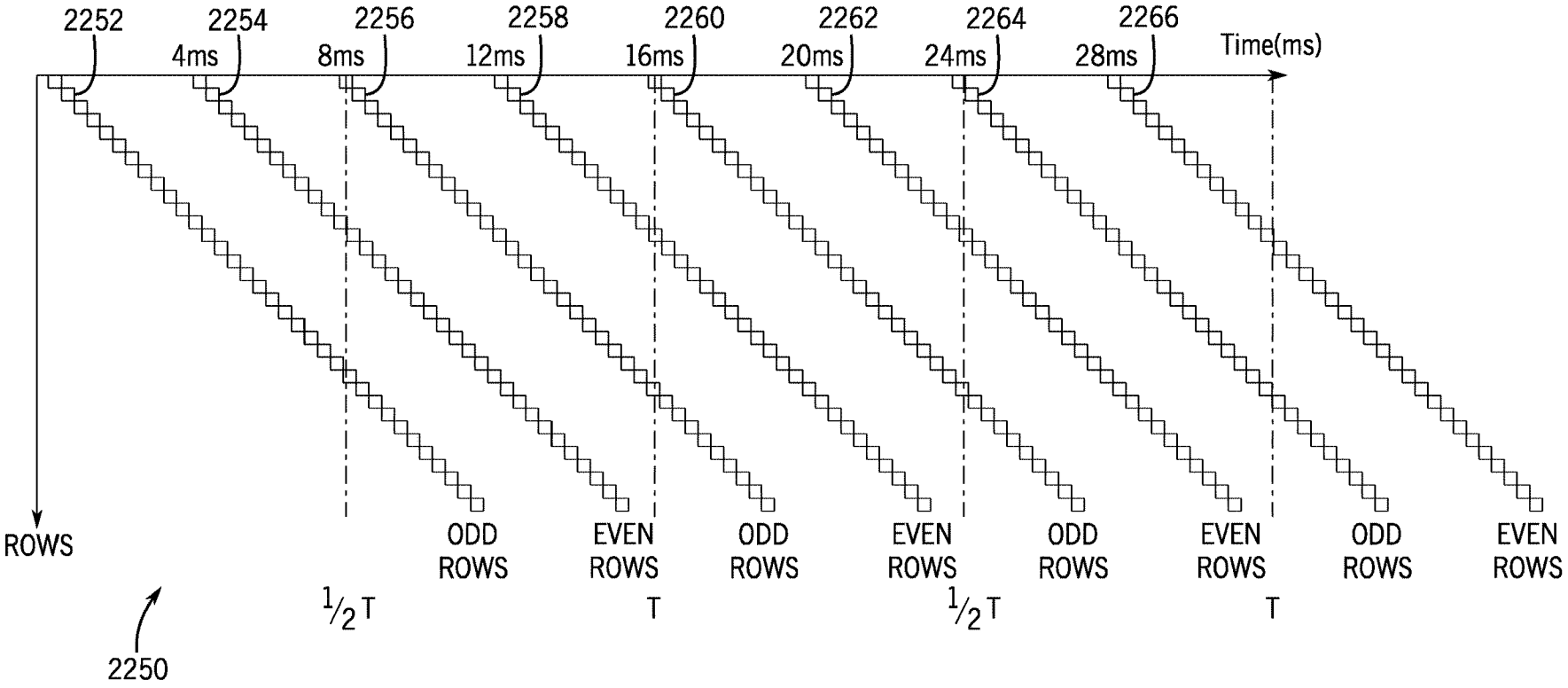
FIG. 23 illustrates a timing diagram for alternatingly driving odd and even rows, in accordance with an embodiment.

FIG. 23 illustrates an embodiment of a timing diagram 2250. As illustrated, four emission scans are initiated per period T. For example, scans 2252, 2254, 2256, and 2258 are initiated within a first period of scanning, and scans 2260, 2262, 2264, and 2266 are performed in a second period of scanning. As illustrated, the rows alternate between odd and even. If the refresh rate is 60 Hz frame, each of these sub-frames are initiated at a rate of 240 Hz. Thus, a new scan is performed every 1/4T, and a single line is scanned every 1/2T. For example, the first odd line is scanned at 0 time, 1/2T, T, and so forth. This emission is evenly distributed over space and time to reduce dynamic artifacts and IR drop (analog and digital). Using the foregoing timing diagram. Two neighboring rows do not emit at the same time thereby enabling a single microdriver to control emission of the pixels in a first row and a neighboring second row using time multiplexing since the two rows do not emit at the same time. This reuse of hardware reduces pin and area usage thereby reducing manufacturing costs of the electronic device. The microdriver may use a single set of emission control logic with (double pixel data buffers), a single current driver, and/or single set of emission clocks (one of each phase). This method works as long as the duty cycle is limited to less than or equal to 50%.

Figure 24:
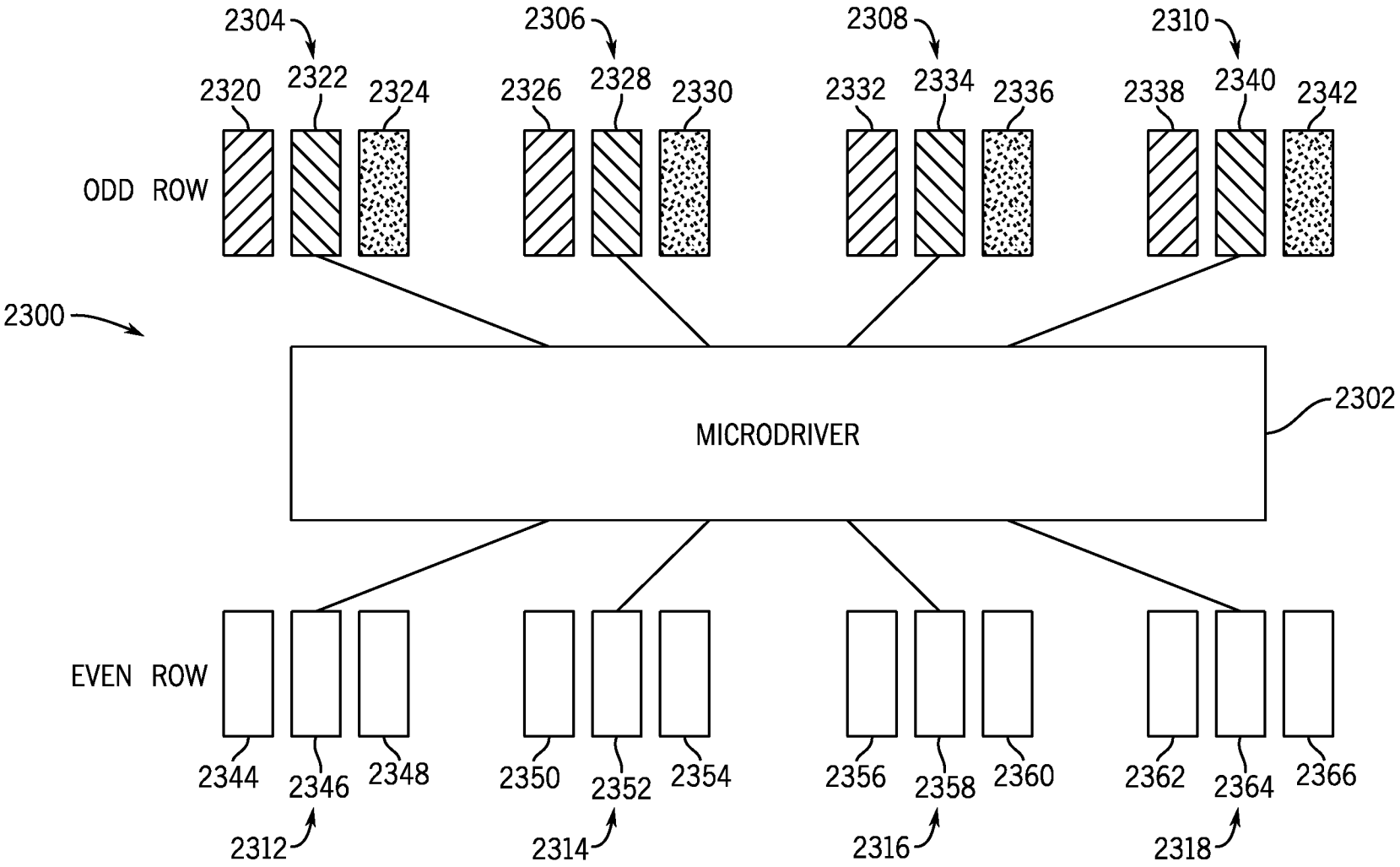
FIG. 24 illustrates a block diagram of a pixel driving system including a microdriver and driven pixels, in accordance with an embodiment.

FIG. 24 illustrates an embodiment of a pixel driving system 2300. The pixel driving system 2300 includes a microdriver that drives and controls pixels 2304, 2306, 2308, 2310, 2312, 2314, 2316, and 2318 using time-multiplexing. Although the illustrated embodiment includes driving eight pixels in a four-column, two-row configuration, the eight pixels may be driven in a different configuration, such as a two-row, four-column configuration. Furthermore, the microdriver may drive more or less pixels with corresponding restrictions. For example, the microdriver may instead drive four rows of five pixels, each row limited to a 25% duty cycle and each pixel having a 5% duty cycle.

Returning to FIG. 25, during a first period, the microdriver drives pixels 2304, 2306, 2308, and/or 2310, and during a second period, the microdriver drives pixels 2312, 2314, 2316, and 2318. Each pixel includes multiple sub-pixels. For example, pixel 2304 includes red sub-pixel 2320, green sub-pixel 2322, and blue sub-pixel 2324. Similarly, pixel 2306 includes red sub-pixel 2326, green sub-pixel 2328, and blue sub-pixel 2330; pixel 2308 includes red sub-pixel 2332, green sub-pixel 2334, and blue sub-pixel 2336; pixel 2310 includes red sub-pixel 2336, green sub-pixel 2338, and blue sub-pixel 2340; pixel 2312 includes red sub-pixel 2342, green sub-pixel 2344, and blue sub-pixel 2346; pixel 2314 includes red sub-pixel 2348, green sub-pixel 2350, and blue sub-pixel 2352; pixel 2316 includes red sub-pixel 2354, green sub-pixel 2356, and blue sub-pixel 2358; and pixel 2318 includes red sub-pixel 2360, green sub-pixel 2362, and blue sub-pixel 2364.

Figure 25:
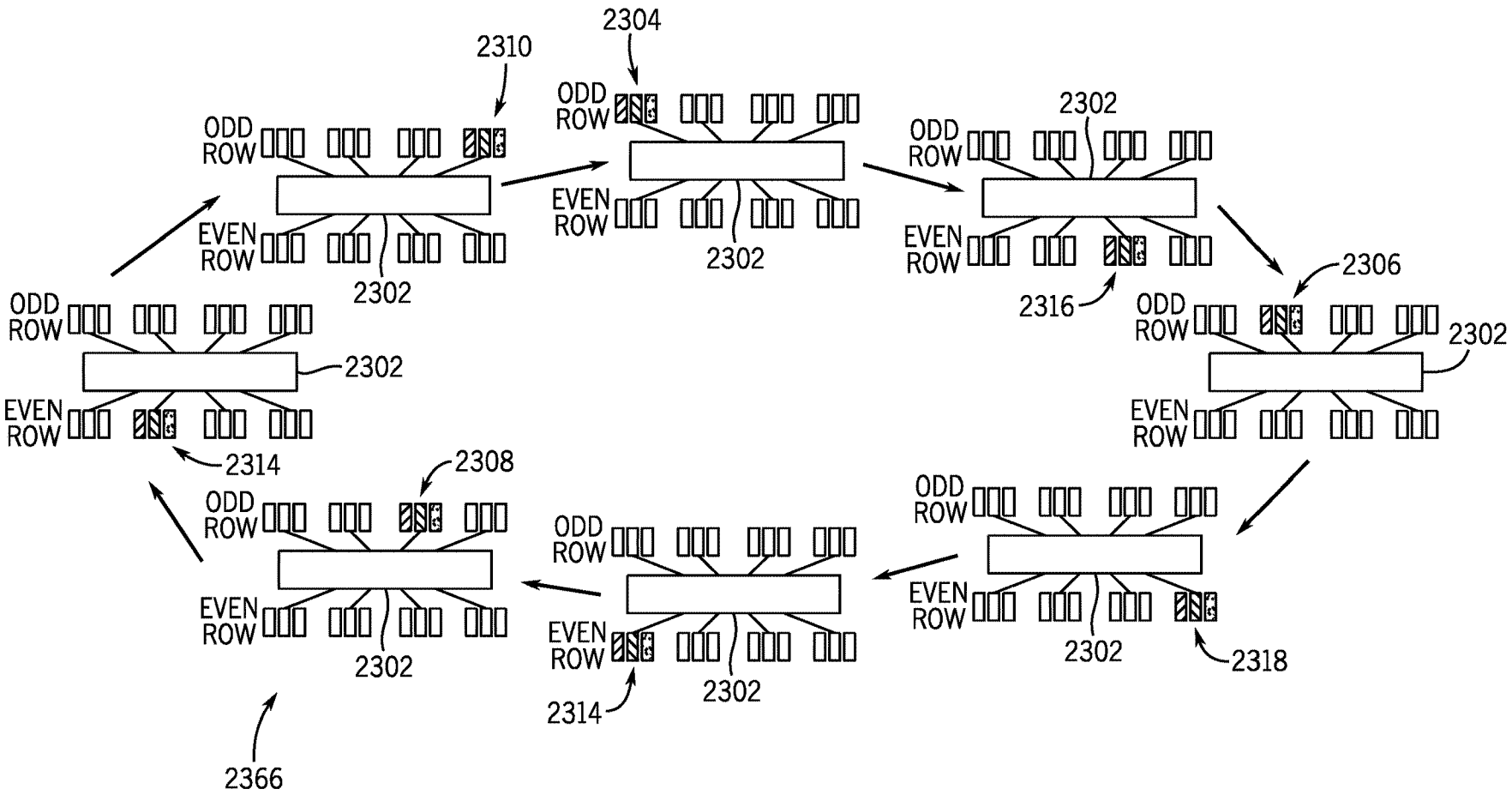
FIG. 25 illustrates a timing diagram that may be used to drive eight pixels using eight-way time-multiplexing, in accordance with an embodiment.

FIG. 25 illustrates a timing diagram 2366 that may be used to drive pixels 2304-2318 using eight-way time-multiplexing with 4 pixels in columns and 2 pixels in rows, every pixel in the microdriver may share resources thereby reducing hardware area and/or pin counts around the microdriver to reduce manufacturing overhead or provide additional display fidelity. It is important to note that although eight-way time multiplexing is discussed, 2, 3, 4, 5, 6, 7, or more-way multiplexing may be employed in some embodiments. Under such sharing, the duty cycle for each microled (e.g., pixel 2304) is limited to 1/4 of the overall duty cycle of a row for the microdriver. For example, when four pixels are driven in a row by the microdriver, each of the pixels has a maximum emission period of 12.5%. As illustrated, the pixel driving pattern includes skipping rows and columns such that a currently emitting pixel is not adjacent to a a previous or next emitting pixel. Thus, the emissions are distributed throughout the region to reduce IR drop appearance while enabling the pixel data to be time-multiplexed for all of the pixels connected to the microdriver 2302.

Figure 26:
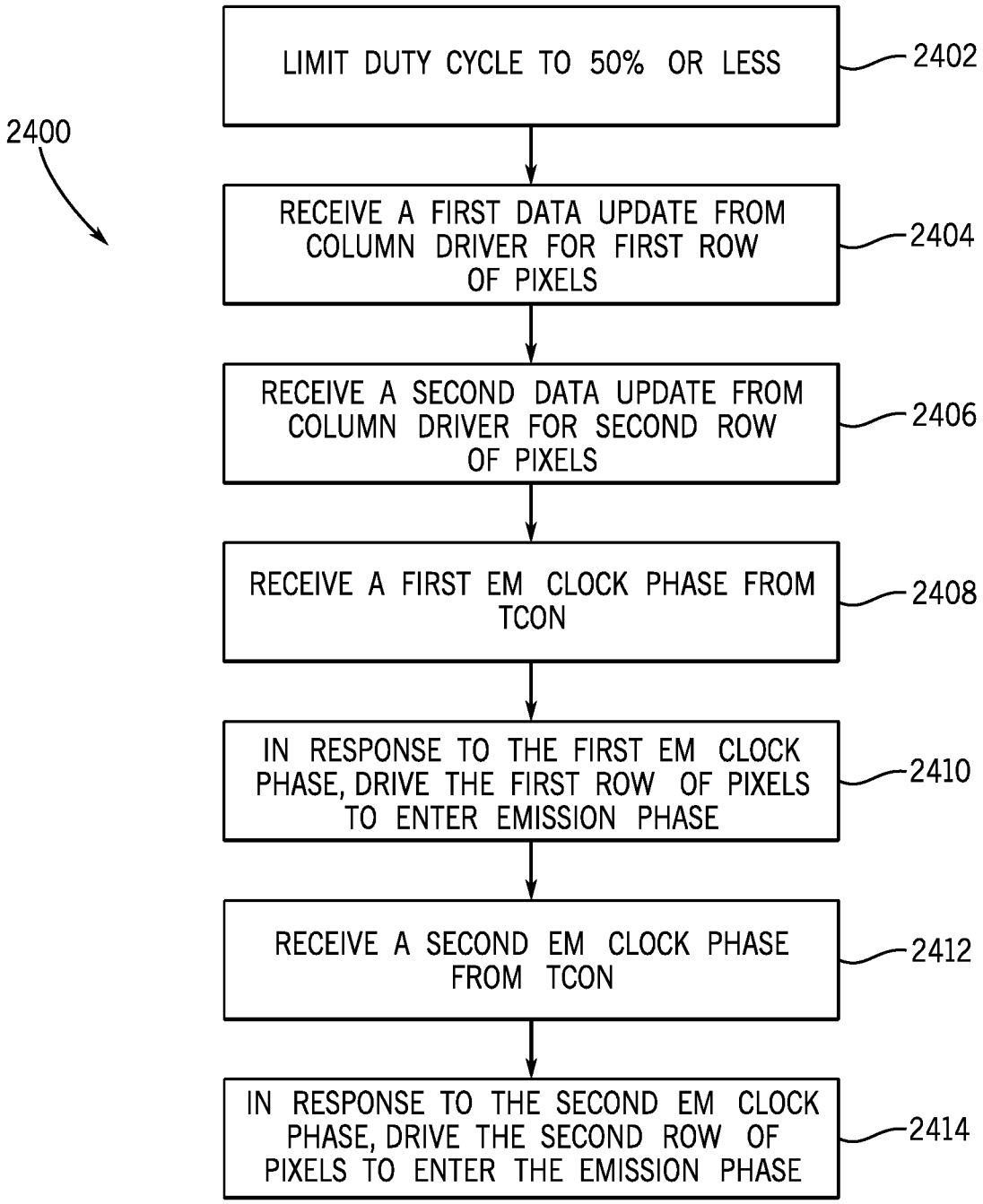
FIG. 26 illustrates a process for operating a microdriver for driving pixels of a display, in accordance with an embodiment.

FIG. 26 illustrates a process 2400 for operating a microdriver. The process 2400 includes limiting duty cycle of a row to 50% or less (block 2402). The process 2400 also includes receiving, at a microdriver, a first data update from a column driver for a first row of pixels (block 2404). The microdriver also receives a second data update from a column driver for a second row of pixels (block 2406). In some embodiments, these data updates may be time limited such that the first data is written and cleared before the second data update is received. In other words, a single buffer may be used to store the first and second data updates. However, in some embodiments, the received data updates may be stored in different buffers. The microdriver receives a first emission clock phase from a timing controller (block 2408). In response to the first emission clock phase, the microdriver drives the first first to enter an emission state (block 2410). For example, the microdriver 2302 may cause the pixels 2304, 2306, 2308, and/or 2310 to emit light based on the received data update.

After or during emission via the first row of pixels, the microdriver receives a second emission clock phase from the timing controller (block 2414). In response to the second emission clock phase and when the first period has ended, drive the second row of pixels to enter the emission phase (block 2414).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Moreover, although the foregoing discusses row drivers that send data to microdrivers and column drivers that control which microdriver in a row receives the data, it should be appreciated that the foregoing discussion about row drivers may be applied to column drivers and vice versa merely by rotating orientation of the display. Thus, recitations of columns and rows may be interchangeable in meaning herein.

What is claimed is:

1. An electronic device comprising:

a timing controller that generates a plurality of emission clock phases;

a plurality of row drivers configured to receive the plurality of emission clock phases and comprising:

a first row driver of the plurality of row drivers configured to:

receive a first emission clock phase of the plurality of emission clock phases; and drive a first row of pixels into an emission phase using the first emission clock phase of the plurality of emission clock phases, wherein driving the first row of pixels comprises routing the first emission clock phase to the first row of pixels; and a second row driver of the plurality of row drivers configured to:

receive a second emission clock phase of the plurality of emission clock phases; and drive a second row of pixels into an emission phase using the second emission clock phase of the plurality of emission clock phases, wherein driving the second row of pixels comprises routing the second emission clock phase to the second row of pixels;

a third row driver of the plurality of row drivers configured to:

receive a third emission clock phase of the plurality of emission clock phases; and drive a third row of pixels into an emission phase using the third emission clock phase of the plurality of emission clock phases; and a fourth row driver of the plurality of row drivers configured to:

receive a fourth emission clock phase of the plurality of emission clock phases; and drive a fourth row of pixels into an emission phase using the fourth emission clock phase of the plurality of emission clock phases, wherein:

the first row driver also receives the second emission clock phase, the third emission clock phase, and the fourth emission clock phase;

the second row driver also receives the first emission clock phase, the third emission clock phase, and the fourth emission clock phase;

the third row driver also receives the first emission clock phase, the second emission clock phase, and the fourth emission clock phase; and the fourth row driver also receives the first emission clock phase, the second emission clock phase, and the third emission clock phase.

2. The electronic device of claim 1, wherein the plurality of row drivers comprises:

a fifth row driver of the plurality of row drivers configured to:

receive a fifth emission clock phase of the plurality of emission clock phases; and drive a fifth row of pixels into an emission phase using the fifth emission clock phase of the plurality of emission clock phases; and a sixth row driver of the plurality of row drivers configured to:

receive a sixth emission clock phase of the plurality of emission clock phases; and drive a sixth row of pixels into an emission phase using the sixth emission clock phase of the plurality of emission clock phases.

3. The electronic device of claim 2, wherein:

the first row driver also receives the second emission clock phase, the third emission clock phase, the fourth emission clock phase, the fifth emission clock phase, and the sixth emission clock phase;

the second row driver also receives the first emission clock phase, the third emission clock phase, the fourth emission clock phase, the fifth emission clock phase, and the sixth emission clock phase;

the third row driver receives the first emission clock phase, the second emission clock phase, the fourth emission clock phase, the fifth emission clock phase, and the sixth emission clock phase; and the fourth row driver receives the first emission clock phase, the second emission clock phase, the third emission clock phase, the fifth emission clock phase, and the sixth emission clock phase;

the fifth row driver receives the first emission clock phase, the second emission clock phase, the third emission clock phase, the fourth emission clock phase, and the sixth emission clock phase; and the sixth row driver receives the first emission clock phase, the second emission clock phase, the third emission clock phase, the fourth emission clock phase, and the fifth emission clock phase.

4. The electronic device of claim 1 comprising a microdriver configured to receive the first emission clock phase from the first row driver to drive at least a portion of the first row of pixels.

5. The electronic device of claim 4, wherein the microdriver is configured to drive at least a portion of a third row of pixels.

6. A method comprising:

receiving, at a first row driver of a display, a plurality of emission clock phases from a timing controller, wherein the plurality of emission clock phases are configured to enable staggered emission of a frame of image data;

sending, using the first row driver, a first emission clock phase of the received plurality of emission clock phases to a first microdriver to cause the first microdriver to use the first emission clock phase to drive a first portion of pixels coupled to the first microdriver to an emission state, wherein driving the first portion of pixels comprises driving the first portion of pixels without driving a second portion of pixels coupled to the first microdriver to the emission state;

sending, using a second row driver, a second emission clock phase of the plurality of emission clock phases to a second microdriver to cause the second microdriver to use the second emission clock phase to drive at least a portion of a second row of pixels to an emission state;

sending, using a third row driver, a third emission clock phase of the plurality of emission clock phases to a third microdriver to cause the third microdriver to use the third emission clock phase to drive at least a portion of a third row of pixels to an emission state;

sending, using a fourth row driver, a fourth emission clock phase of the plurality of emission clock phases to a fourth microdriver to cause the fourth microdriver to use the fourth emission clock phase to drive at least a portion of a fourth row of pixels to an emission state;

sending, using a fifth row driver, a fifth emission clock phase of the plurality of emission clock phases to a fifth microdriver to cause the fifth microdriver to use the fifth emission clock phase to drive at least a portion of a fifth row of pixels to an emission state; and sending, using a sixth row driver, a sixth emission clock phase of the plurality of emission clock phases to a sixth microdriver to cause the sixth microdriver to use the sixth emission clock phase to drive at least a portion of a sixth row of pixels to an emission state.

7. The method of claim 6 comprising sending, using the first row driver, a second emission clock phase of the plurality of emission clock phases to the first microdriver to cause the first microdriver to use the second emission clock phase to drive a second portion of pixels coupled to the first microdriver to the emission state, wherein driving the second portion of pixels comprises driving the second portion of pixels without driving the first portion of pixels to the emission state.

8. The method of claim 6 comprising alternatively driving odd rows of pixels and even rows of pixels in the display.

9. The method of claim 6 comprising:

receiving the first emission clock phase at the first microdriver; and driving at least a portion of first row of pixels to an emission state.

10. An electronic display comprising:

a timing controller configured to distribute emission periods throughout an active area of a display over time by generating a plurality of emission clock phases; and a plurality of row drivers configured to cause rows of pixels to emit at a plurality of emission periods, wherein the plurality of row drivers comprises first, second, third, and fourth row drivers configured to respectively drive first, second, third, and fourth rows of pixels, and wherein causing rows of pixels to emit comprises causing each row driver of the plurality of row drivers to:

receive each of a plurality of emission clock phases, wherein the plurality of emission clock phases comprises first, second, third, and fourth emission clock phases, wherein the first row driver is configured to receive the first, second, third, and fourth emission clock phases, the second row driver is configured to receive the first, second, third, and fourth emission clock phases, the third row driver is configured to receive the first, second, third, and fourth emission clock phases, and the fourth row driver is configured to receive the first, second, third, and fourth emission clock phases;

elect a respective emission clock phase of the plurality of emission clock phases; and route the respective emission clock phase to corresponding pixels of the rows of pixels by respectively routing the first, second, third, and fourth emission clock phases to the first, second, third, and fourth row drivers to respectively drive the first, second, third, and fourth rows of pixels, wherein the first row driver drives corresponding pixels of the first row of pixels using the first emission clock phase, the second row driver drives corresponding pixels of the second row of pixels using the second emission clock phase, the third row driver drives corresponding pixels of the third row of pixels using the third emission clock phase, and the fourth row driver drives corresponding pixels of the fourth row of pixels using the fourth emission clock phase.

11. The electronic display of claim 10, wherein the plurality of emission clock phases comprises six emission clock phases, and the plurality of emission periods comprises six emission periods.

12. The electronic display of claim 10 comprises a plurality of microdrivers, wherein each microdriver of the plurality of microdrivers receives an emission clock phase of the plurality of emission clock phases from a respective row driver of the plurality of row drivers.

13. The electronic display of claim 12 comprises a plurality of column drivers, wherein each column driver sends data updates to a column of microdrivers of the plurality of microdrivers prior to an emission state for each microdriver in the column of microdrivers.

14. The electronic display of claim 12, wherein each microdriver is configured to drive two rows of the pixels using time-multiplexing.

15. A method comprising:

receiving pixel data corresponding to an image frame, at a first microdriver, from a queuing driver;

using the first microdriver with a first emission clock phase of a plurality of emission clock phases to drive a first portion of pixels coupled to the first microdriver to an emission state without driving a second portion of pixels coupled to the first microdriver to the emission state;

using the first microdriver with a second emission clock phase of the plurality of emission clock phases to drive the second portion of pixels in a second row to an emission state without driving the first portion of pixels to the emission state;

sending, using a second queueing driver, a second emission clock phase of the plurality of emission clock phases to a second microdriver to cause the second microdriver to use the second emission clock phase to drive at least a portion of a third portion of pixels to an emission state;

sending, using a third queueing driver, a third emission clock phase of the plurality of emission clock phases to a third microdriver to cause the third microdriver to use the third emission clock phase to drive at least a portion of a fourth portion of pixels to an emission state;

sending, using a fourth queueing driver, a fourth emission clock phase of the plurality of emission clock phases to a fourth microdriver to cause the fourth microdriver to use the fourth emission clock phase to drive at least a portion of a fifth portion of pixels to an emission state;

sending, using a fifth queueing driver, a fifth emission clock phase of the plurality of emission clock phases to a fifth microdriver to cause the fifth microdriver to use the fifth emission clock phase to drive at least a portion of a sixth portion of pixels to an emission state; and sending, using a sixth queueing driver, a sixth emission clock phase of the plurality of emission clock phases to a sixth microdriver to cause the sixth microdriver to use the sixth emission clock phase to drive at least a portion of a seventh portion of pixels to an emission state.

16. The method of claim 15, wherein the queueing driver comprises a row driver.

17. The method of claim 15, wherein the queueing driver comprises a column driver.

18. The method of claim 15, wherein the first portion of pixels comprises four pixels, and the second portion of pixels comprises four pixels.

19. The method of claim 18 comprising time multiplexing data driving at the first microdriver to enable the first microdriver to drive all pixels in the first and second portions of pixels.

20. A method comprising:

limiting duty cycle to less than half of a period corresponding to a display of a frame of image data;

receiving, at a microdriver, a first data update from a column driver for a first portion of pixels coupled to the microdriver;

receiving, at the microdriver, a second data update from the column driver for a second portion of pixels coupled to the microdriver;

receiving, at the microdriver at a first time, a first emission clock phase of a plurality of emission clock phases from a timing controller via a row driver;

in response to the first emission clock phase and after receiving the first data update, driving, using the microdriver, the first portion of pixels to enter an emission phase during a first portion of the period without a second portion entering the emission phase during the first portion of the period;

receiving, at the microdriver at a second time, a second emission clock phase of the plurality of emission clock phases from a timing controller via a row driver;

in response to the second emission clock phase and after receiving the second data update, driving, using the microdriver, the second portion of pixels to enter an emission phase during a second portion of the period without the first portion entering the emission phase during the second portion of the period;

sending, using a second column driver, a second emission clock phase of the plurality of emission clock phases to a second microdriver to cause the second microdriver to use the second emission clock phase to drive at least a portion of a third portion of pixels to an emission state;

sending, using a third column driver, a third emission clock phase of the plurality of emission clock phases to a third microdriver to cause the third microdriver to use the third emission clock phase to drive at least a portion of a fourth portion of pixels to an emission state;

sending, using a fourth column driver, a fourth emission clock phase of the plurality of emission clock phases to a fourth microdriver to cause the fourth microdriver to use the fourth emission clock phase to drive at least a portion of a fifth portion of pixels to an emission state;

sending, using a fifth column driver, a fifth emission clock phase of the plurality of emission clock phases to a fifth microdriver to cause the fifth microdriver to use the fifth emission clock phase to drive at least a portion of a sixth portion of pixels to an emission state; and sending, using a sixth column driver, a sixth emission clock phase of the plurality of emission clock phases to a sixth microdriver to cause the sixth microdriver to use the sixth emission clock phase to drive at least a portion of a seventh portion of pixels to an emission state.

* * * * *